US012098718B2

(12) United States Patent
Choi et al.

(10) Patent No.: US 12,098,718 B2
(45) Date of Patent: Sep. 24, 2024

(54) ROTARY COMPRESSOR

(71) Applicant: LG ELECTRONICS INC., Seoul (KR)

(72) Inventors: Yongkyu Choi, Seoul (KR); Kiyoul Noh, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/972,767

(22) Filed: Oct. 25, 2022

(65) Prior Publication Data

US 2023/0137362 A1 May 4, 2023

(30) Foreign Application Priority Data

Nov. 3, 2021 (KR) ..... 10-2021-0149901

(51) Int. Cl.
*F04C 18/344* (2006.01)
*F04C 14/12* (2006.01)
(Continued)

(52) U.S. Cl.
CPC ..... *F04C 14/12* (2013.01); *F04C 18/344* (2013.01); *F04C 23/008* (2013.01); *F04C 29/0035* (2013.01); *F04C 2240/50* (2013.01)

(58) Field of Classification Search
CPC ..... F04C 18/344; F04C 18/3441; F04C 18/3446; F04C 18/3562; F04C 18/3564;
(Continued)

(56) References Cited

U.S. PATENT DOCUMENTS 3,762,843 A * 10/1973 Suzuki ..... F04C 15/062 418/268
4,455,129 A 6/1984 Sakatani et al.
2004/0131477 A1* 7/2004 Dalton ..... F04C 14/28 417/279

FOREIGN PATENT DOCUMENTS

CN 110966194 11/2020
EP 1 531 270 5/2005
(Continued)

OTHER PUBLICATIONS

JPS63186982A—Nakajima et al.—Vane Type Compressor—Aug. 2, 1988—the English Machine Translation. (Year: 1988).*
(Continued)

*Primary Examiner* — Theresa Trieu
(74) *Attorney, Agent, or Firm* — KED & ASSOCIATES

(57) ABSTRACT

A rotary compressor, including a cylinder, an inner peripheral surface of which is defines a compression space, provided with a suction port configured to communicate with the compression space to suction and provide refrigerant to the compression space; a roller rotatably provided in the compression space of the cylinder, and including with a plurality of vane slots at predetermined intervals along an outer peripheral surface, the plurality of vanes each providing a back pressure at one side thereinside; a plurality of vanes slidably inserted into the plurality of vane slots, respectively, to rotate together with the roller, front end surfaces of the plurality of vanes coming into contact with an inner periphery of the cylinder due to the back pressure to partition the compression space into a plurality of compression chambers; and a main bearing and a sub bearing provided at both ends of the cylinder, respectively.

19 Claims, 27 Drawing Sheets

(51) Int. Cl.
*F04C 23/00* (2006.01)
*F04C 29/00* (2006.01)

(58) Field of Classification Search
CPC ..... F04C 23/008; F04C 29/0035; F04C 2240/20; F04C 2240/50; F01C 1/344; F01C 21/0863; F01C 21/10
See application file for complete search history.

(56) References Cited

FOREIGN PATENT DOCUMENTS

| | | |
|---|---|---|
| JP | 60-32989 | 2/1985 |
| JP | 63-186982 | 8/1988 |
| JP | 2006-161696 | 6/2006 |
| JP | 2013-213438 | 10/2013 |
| JP | 2014-125962 | 7/2014 |
| KR | 10-202-0057542 | 5/2020 |
| KR | 10-2020-0057542 | 5/2020 |

OTHER PUBLICATIONS

CN110966194B—Wen et al.—Compressor and sliding vane compressor back pressure control structure—Nov. 24, 2020—the English Machine Translation (Year: 2020).*
European Search Report issued in Application No. 22203968.7 dated Mar. 29, 2023.
Korean Notice of Allowance dated Jul. 4, 2023.

* cited by examiner

ROTARY COMPRESSOR

CROSS-REFERENCE TO RELATED APPLICATION(S)

Pursuant to 35 U.S.C. § 119(a), this application claims the benefit of an earlier filing date of and the right of priority to Korean Patent Application No. 10-2021-0149901, filed in Korea on Nov. 3, 2021, the contents of which are incorporated by reference herein in its entirety.

BACKGROUND

1. Field

A rotary compressor is disclosed herein.

2. Background

Compressors may be divided into a reciprocating compressor, a rotary compressor, and a scroll compressor according to a method of compressing refrigerant. The reciprocating compressor uses a method in which a compression space is disposed between a piston and a cylinder, and the piston linearly reciprocates to compress a fluid, the rotary compressor uses a method of compressing a fluid by a roller that eccentrically rotates inside of a cylinder, and the scroll compressor uses a method in which a pair of spiral scrolls engage and rotate to compress a fluid.

Among them, the rotary compressor may be divided according to a method in which the roller rotates with respect to the cylinder. For example, the rotary compressor may be divided into an eccentric rotary compressor in which a roller rotates eccentrically with respect to a cylinder, and a concentric rotary compressor in which a roller rotates concentrically with respect to a cylinder. In addition, the rotary compressor may be divided according to a method of dividing a compression chamber. For example, it may be divided into a vane rotary compressor in which vanes come into contact with a roller or a cylinder to partition a compression space, and an elliptical rotary compressor in which part of an elliptical roller comes into contact with a cylinder to partition a compression space.

The rotary compressor as described above is provided with a drive motor, a rotational shaft is coupled to a rotor of the drive motor, and a rotational force of the drive motor is transmitted to a roller through the rotational shaft to compress refrigerant.

For a rotary compressor in the related art, our vane compressor has a multi-back pressure chamber structure in which a back pressure acting on a vane is divided into an intermediate back pressure and a discharge back pressure, and competitors may use a single back pressure chamber structure. A pressure in a discharge back pressure chamber is formed by an oil pressure supplied from an oil storage space (sump). A pressure of an intermediate back pressure chamber is formed as a gap leakage between a rotor and a main/sub bearing by a suction or compression chamber pressure and a discharge pressure.

In such a rotary compressor in the related art, as the pressure of the intermediate back pressure chamber is formed by the suction or compression chamber pressure and the discharge pressure, the influence of the discharge pressure is relatively higher than that of the suction or compression chamber pressure. The pressure of the intermediate back pressure chamber is formed at a level of approximately 60 to 70% of the discharge pressure.

A contact force Fv of the vane is formed by a difference in subtracting a leading edge force Fc of the vane from a back pressure Fb of the vane. The leading edge force Fc of the vane has a characteristic that decreases as the suction pressure decreases.

Japanese Patent Application Laid-Open No. 2014-125962 (hereinafter "Patent Document 1"), which is hereby incorporated by reference, discloses a vane rotary type gas compressor in which vane front ends of vanes come into contact with an inner peripheral surface of the cylinder to divide a space formed between the inner peripheral surface of the cylinder and an outer peripheral surface of the rotor so as to form a plurality of compression chambers.

Japanese Patent Application Laid-Open No. JP2013-213438A (hereinafter "Patent Document 2"), which is hereby incorporated by reference, discloses a vane rotary type gas compressor in which a compressor body includes a substantially cylindrical rotor that rotates integrally with a rotational shaft, a cylinder having a contoured inner peripheral surface surrounding the rotor from an outside of a circumferential surface thereof, and a bearing rotatably supporting a plurality of plate-shaped vanes provided so as to protrude outward from the circumferential surface of the rotor. The rotational shaft protrudes from both end surfaces of the rotor, respectively, and a protruding front end of each protruding vane comes in contact with the inner peripheral surface of the cylinder to partition into a plurality of compression chambers by an outer peripheral surface of the rotor, the inner peripheral surface of the cylinder, respective inner surfaces of both side blocks, and two vane surfaces that move forward and backward along a rotational direction of the rotor.

In the case of such a back pressure structure in the related art, as the pressure of the intermediate pressure chamber conforms to a discharge pressure, a relatively excessive vane back pressure acts under a low suction pressure condition. Due to this, friction loss at a front end of the vane is increased, which leads to a decrease in efficiency, and also leads to a decrease in wear reliability, resulting in a problem in product quality.

In order to solve this problem, as an intermediate pressure chamber back pressure acting on vanes conforms to a discharge pressure in a rotary compressor in the related art, it is required to develop a structure capable of solving the problems of increased friction loss and reduced wear reliability at front ends of the vanes in an operation region where the suction pressure is low.

BRIEF DESCRIPTION OF THE DRAWINGS

Embodiments will be described in detail with reference to the following drawings in which like reference numerals refer to like elements, and wherein:

FIG. 15 is a perspective view in which FIG. 14 is viewed from the other side;

DETAILED DESCRIPTION

Figure 1:
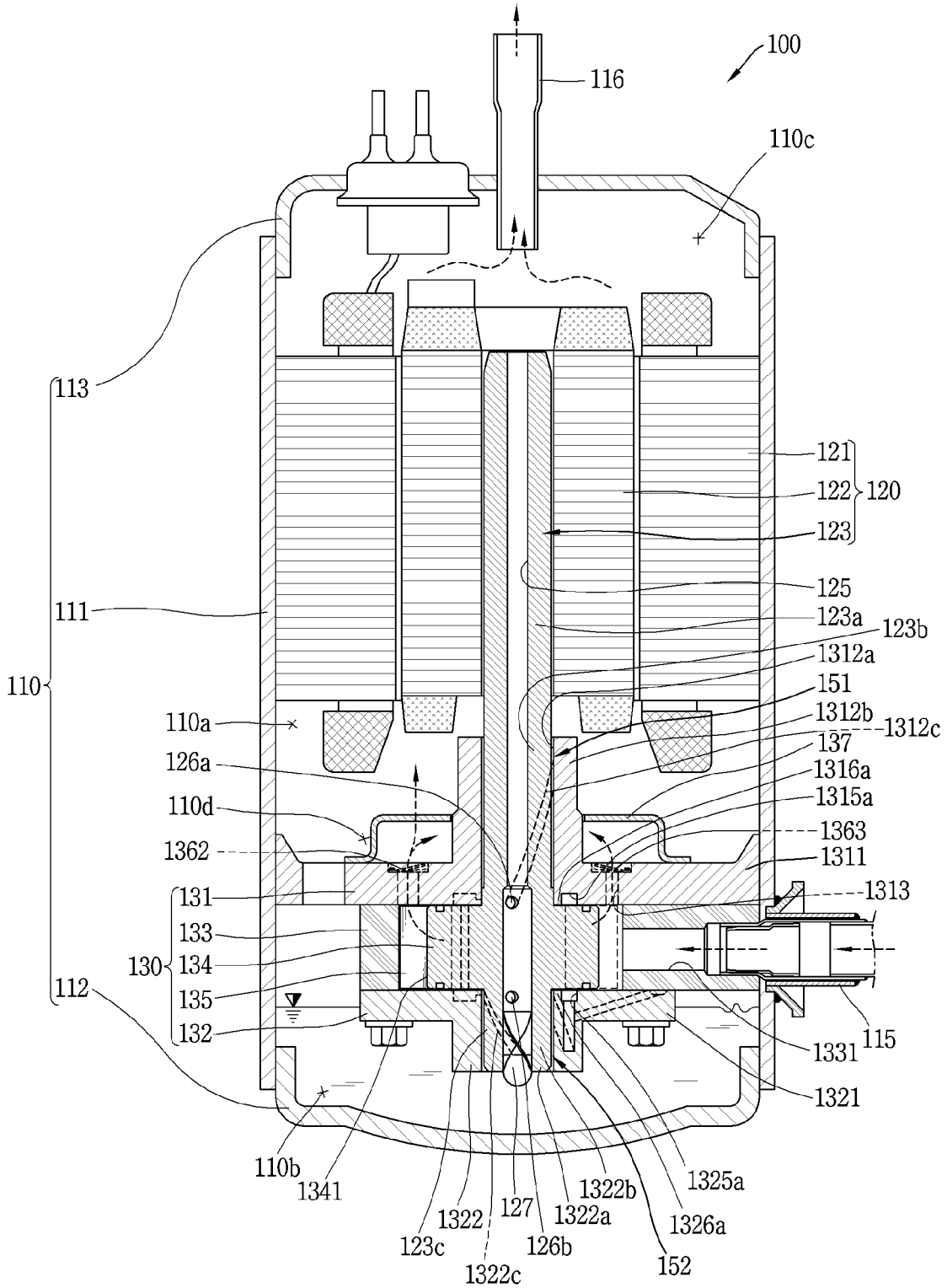
FIG. 1 is a longitudinal sectional view of a rotary compressor according to an embodiment.

Hereinafter, the same or similar reference numerals are assigned to the same or similar components, and redundant description thereof has been omitted. Further, structure applied to any one embodiment may be also applied in the same manner to another embodiment as long as they do not structurally or functionally contradict each other even in different embodiments. Furthermore, a singular representation may include a plural representation unless it represents a definitely different meaning from the context.

In describing an embodiment disclosed herein, moreover, the detailed description will be omitted when specific description for publicly known technologies to which embodiments pertain is judged to obscure the gist. The accompanying drawings are provided only for a better understanding of the embodiments disclosed herein and are not intended to limit technical concepts disclosed herein, and therefore, it should be understood that the accompanying drawings include all modifications, equivalents and substitutes within the concept and technical scope.

Figure 2:
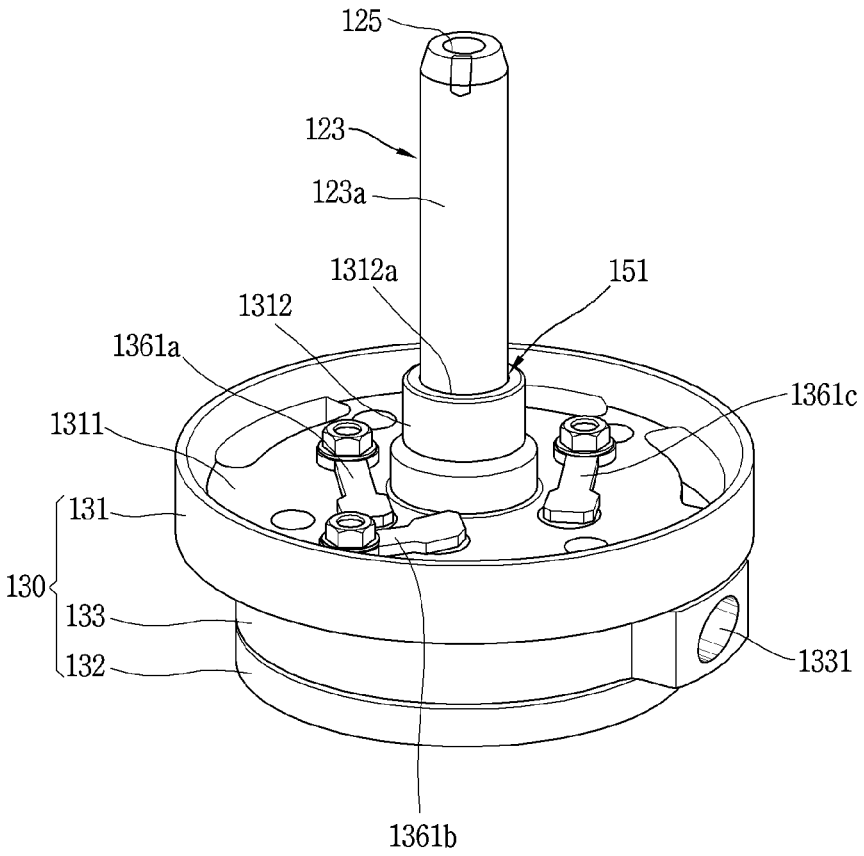
FIG. 2 is a perspective view of a compression unit of the rotary compressor according to an embodiment.
Figure 3:
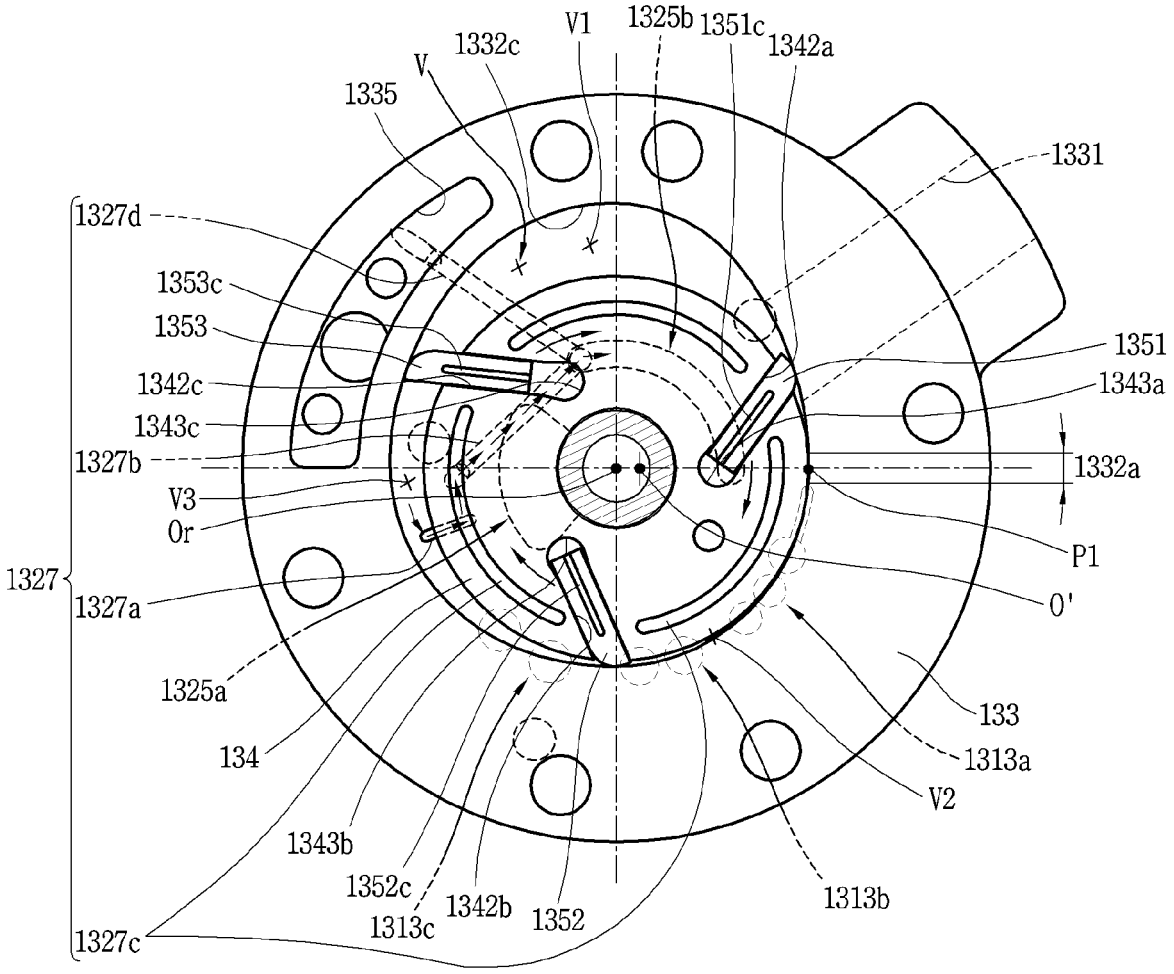
FIG. 3 is a transverse cross-sectional view of the compression unit of the rotary compressor according to an embodiment.
Figure 4:
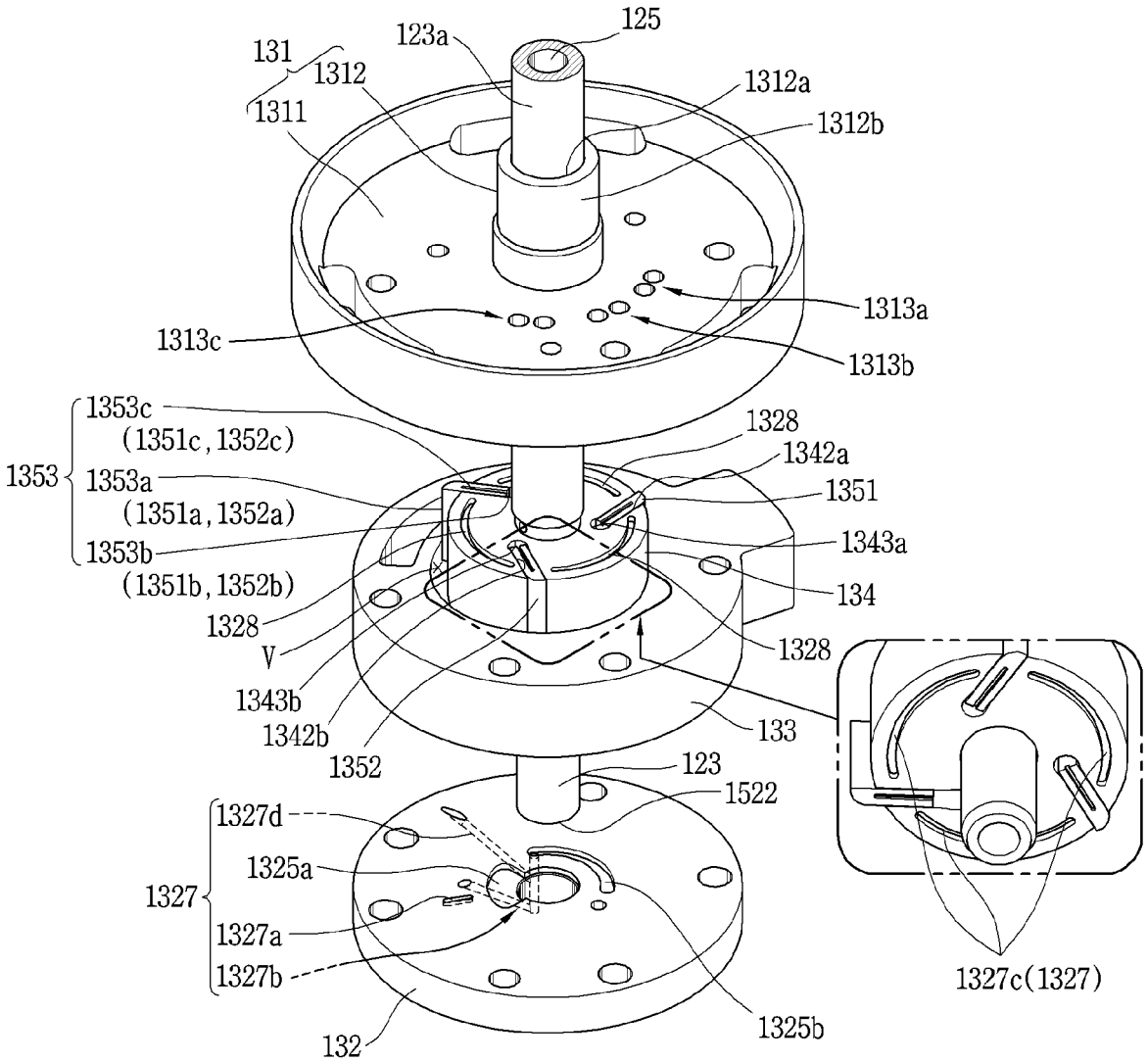
FIG. 4 is an exploded perspective of the compression unit of the rotary compressor according to an embodiment.

FIG. 1 is a longitudinal cross-sectional view of a rotary compressor according to an embodiment, FIG. 2 is a perspective view of a compression unit of the rotary compressor according to an embodiment. FIG. 3 is a transverse cross-sectional view of the compression unit of the rotary compressor according to an embodiment. Further, FIG. 4 is an exploded perspective view of the compression unit of the rotary compressor according to an embodiment.

Hereinafter, rotary compressor 100 according to an embodiment will be described with reference to FIGS. 1 to 4.

The rotary compressor 100 according to an embodiment may be a vane rotary compressor 100. The rotary compressor 100 according to an embodiment may include a cylinder 133, a roller 134, a plurality of vanes 1351, 1352, 1353, a main bearing 131, and a sub bearing 132.

The cylinder 133 has an annular inner peripheral surface 1332 to form a compression space V. Further, the cylinder 133 has a suction port 1331 communicating with the compression space V to suction refrigerant to provide the suctioned refrigerant to the compression space V.

Referring to FIG. 3, the inner peripheral surface 1332 of the cylinder 133 may be defined in an elliptical shape, and the inner peripheral surface 1332 of the cylinder 133 according to an embodiment may be configured such that a plurality of ellipses, for example, four ellipses having different major and minor ratios have two origins to define an asymmetric elliptical shape, and detailed description of the shape of the inner peripheral surface of the cylinder 133 will be described hereinafter.

Further, the cylinder 133 may be provided with a microseism reduction chamber 1335 to reduce a microseism of the pressure in the compression space V. The microseism reduction chamber 1335 may have a space of a preset or predetermined volume, and may communicate with an intermediate back pressure pocket 1325*b* through a second passage 1327*b* or a fourth passage 1327*d* described hereinafter.

Referring to FIG. 3, the microseism reduction chamber 1335 according to an embodiment is shown disposed along a circumferential direction on a left (first) side of the compression space V and defined to pass therethrough in a vertical direction is shown. A communication structure between the microseism reduction chamber 1335 and the intermediate back pressure pocket 1325*b* will be described hereinafter.

The roller 134 is rotatably provided in the compression space V of the cylinder 133. In addition, the roller 134 is configured with a plurality of vane slots 1342*a*, 1342*b*, 1342*c* with a predetermined interval along the outer peripheral surface. The aforementioned compression space V may be formed between an inner periphery of the cylinder 133 and an outer periphery of the roller 134.

That is, the compression space V is a space defined between the inner peripheral surface of the cylinder 133 and the outer peripheral surface of the roller 134. In addition, the compression space V is divided into spaces as many as the number of vanes 1351, 1352, 1353 by the plurality of vanes 1351, 1352, 1353. For example, referring to FIG. 3, an example is shown in which the compression space V is partitioned into a first compression space V1 to a third compression space V3.

The vanes 1351, 1352, 1353 are slidably inserted into the vane slots 1342*a*, 1342*b*, 1342*c*, and are configured to rotate together with the roller 134. In addition, a back pressure is provided at a rear end surface 1351*b*, 1352*b*, 1353*b* of the vane 1351, 1352, 1353 to allow a front end surface 1351*a*, 1352*a*, 1353*a* of the vane 1351, 1352, 1353 to come into contact with the inner periphery of the cylinder 133.

In embodiments disclosed herein, a plurality of the vanes 1351, 1352, 1353 is provided to constitute a multi-back pressure structure, and the front end surfaces 1351*a*, 1352*a*, 1353*a* of the plurality of vanes 1351, 1352, 1353 come into contact with the inner periphery of the cylinder 133, thereby allowing the compression space V to be partitioned into the plurality of compressed spaces V1, V2, V3. An example is shown in which three vanes 1351, 1352, 1353 are provided according to an embodiment, thereby allowing the compression space V to be partitioned into the three compression spaces V1, V2, V3.

The main bearing 131 and the sub bearing 132 may be respectively provided at both ends of the cylinder 133. The main bearing 131 and the sub bearing 132 are spaced apart from each other to constitute both surfaces of the aforementioned compression space V, respectively.

At least one of the main bearing 131 or the sub bearing 132 is provided with the intermediate back pressure pocket 1325*b*. The intermediate back pressure pocket 1325*b* is disposed to communicate with one side of the vane slots 1342*a*, 1342*b*, 1342*c* to provide an intermediate back pressure to the vane slots 1342*a*, 1342*b*, 1342*c*. In embodiments disclosed herein, an example in which the intermediate back pressure pocket 1325*b* is provided in the sub bearing 132 will be mainly described.

In addition, an intermediate pressure back pressure may be provided to the vanes 1351, 1352, 1353, thereby improving contact friction loss and wear reliability acting on the front ends of the vanes 1351, 1352, 1353. For example, referring to FIGS. 1, 2 and 4, an example is shown in which the main bearing 131 is provided at an upper end of the cylinder 133 to define an upper surface of the compression space V, and the sub bearing 132 is provided at a lower end of the cylinder 133 to define a lower surface of the compression space V.

Further, a pressure supply passage 1327 is disposed in at least one of the main bearing 131 or the sub bearing 132 provided with the intermediate back pressure pocket 1325*b*. The pressure supply passage 1327 is configured with a plurality of passages to provide communication between the compression space V and the intermediate back pressure pocket 1325*b* to provide the pressure of the compression space V to the intermediate back pressure pocket 1325*b*.

Figure 5:
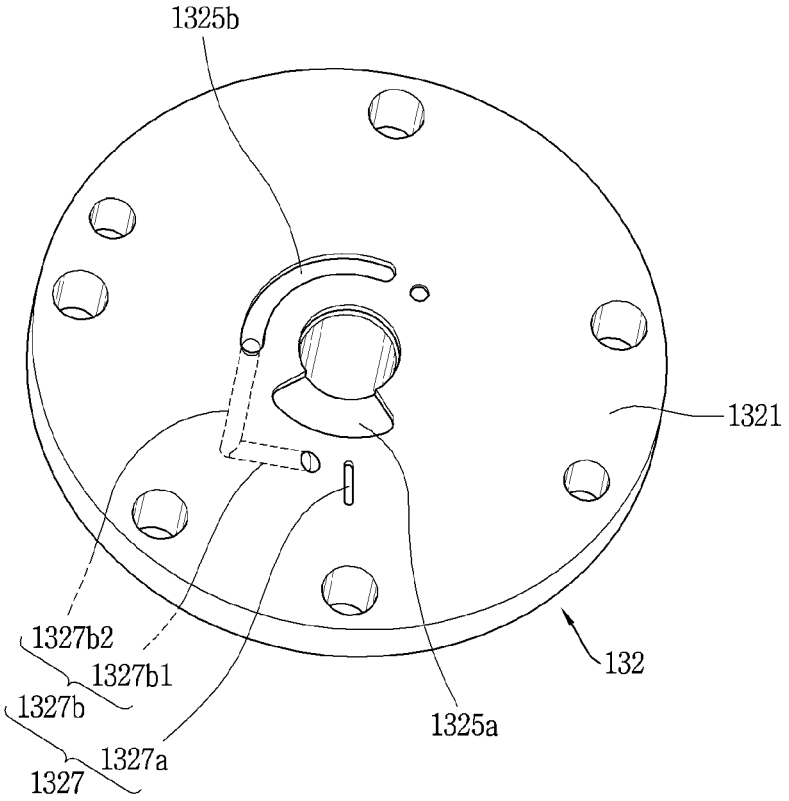
FIG. 5 is a perspective view in which an upper portion of a sub bearing of the rotary compressor according to an embodiment is viewed from one side.
Figure 6:
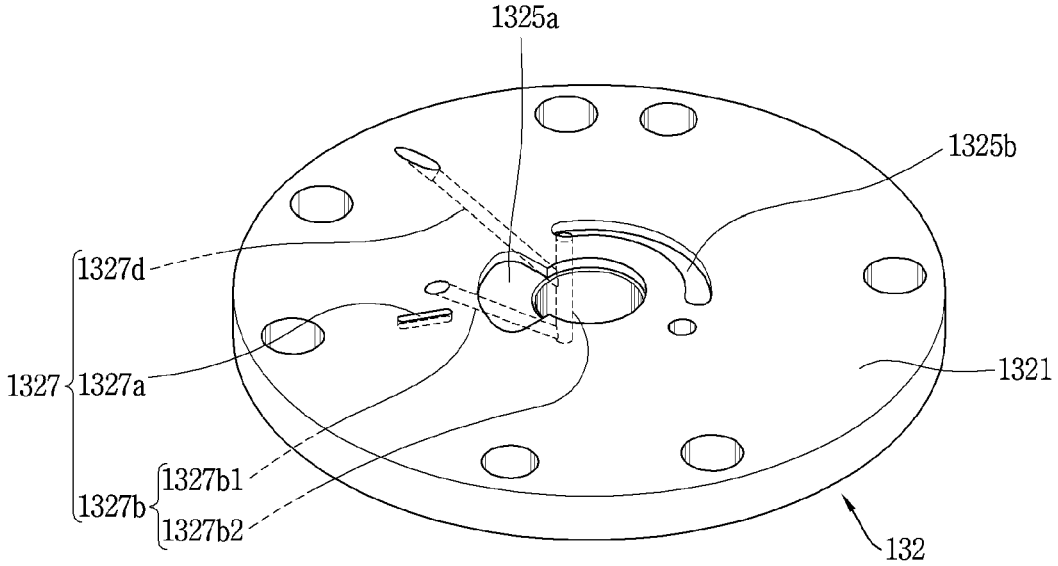
FIG. 6 is a perspective view in which an upper portion of the sub bearing of the rotary compressor according to an embodiment is viewed from the other side.
Figure 7:
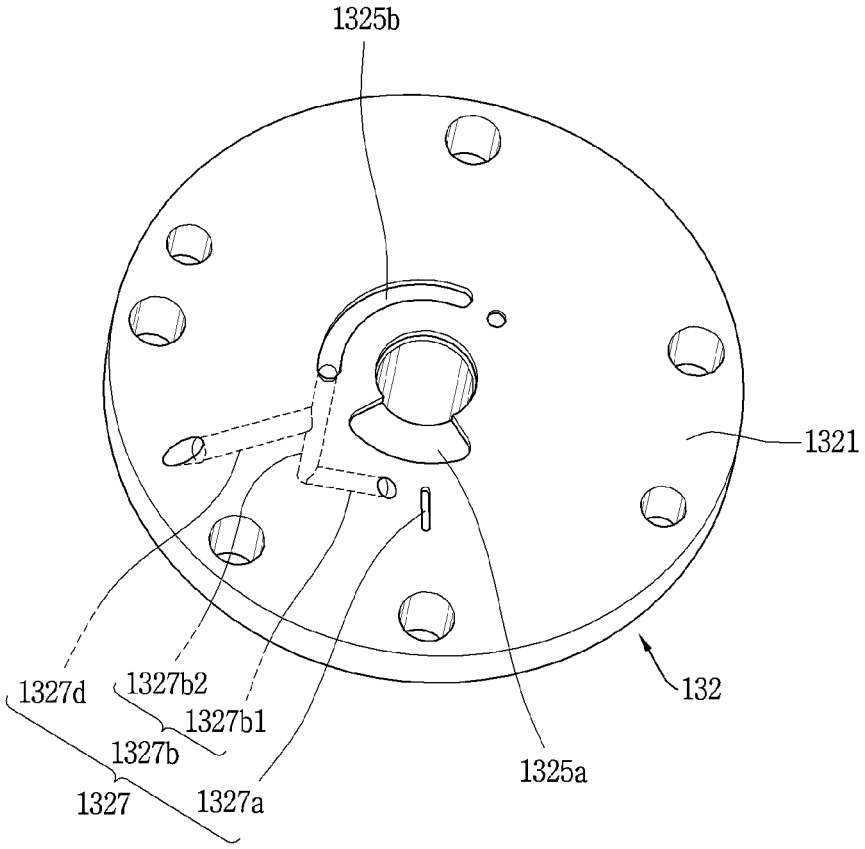
FIG. 7 is a perspective view of a rotary compressor according to an embodiment in which a fourth passage is additionally provided in FIGS. 5 and 6.
Figure 8:
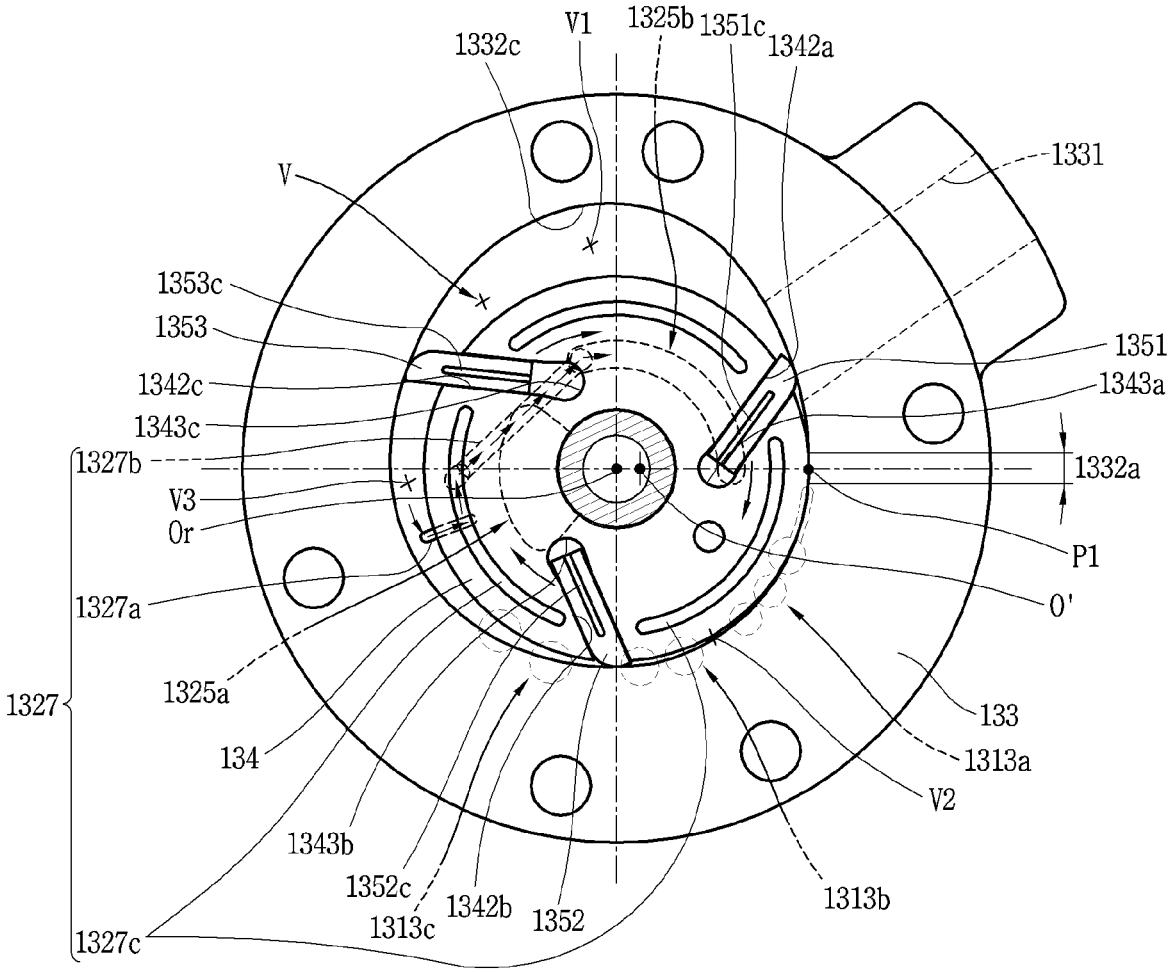
FIG. 8 is a perspective view of the compression unit of the rotary compressor according to another embodiment.

FIG. 5 is a perspective view in which an upper portion of the sub bearing of the rotary compressor according to an embodiment is viewed from one side. FIG. 6 is a perspective view in which an upper portion of the sub bearing of the rotary compressor according to an embodiment is viewed from the other side. FIG. 7 is a perspective view of the rotary compressor according to an embodiment of an example in which the fourth passage is additionally provided in FIGS. 5 and 6.

Referring to FIGS. 4 to 7, an example is shown in which the intermediate back pressure pocket 1325*b* is provided in the sub bearing 132 and the pressure supply passage 1327 is disposed in the sub bearing 132.

In embodiments disclosed herein, the pressure supply passage 1327 may be provided as one of four embodiments, and there is a structural difference in which for pressure supply passage 1327 in this embodiment, the first and second passages 1327*a*, 1327*b* communicate through the third passage 1327*c* defined in the roller 134 without being connected through the microseism reduction chamber 1335, and on the other hand, for pressure supply passage 1327' in another embodiment, the first and second passages 1327*a*, 1327*b* communicate through the microseism reduction chamber 1335. In addition, pressure supply passage 1327" in still another embodiment, which will be described hereinafter, has structure in which the first and second passages 1327*a*, 1327*b* directly communicate, and pressure supply passage 1327''' in yet another embodiment, which will be described hereinafter, has structure in which a compression space and a back pressure pocket communicate via a single passage.

Hereinafter, with reference to FIGS. 3 to 8, the pressure supply passage 1327 according to the embodiment in which the first and second passages 1327*a*, 1327*b* communicate through the third passage 1327*c* defined on the roller 134 will be described. The pressure supply passage 1327 of this embodiment may include first and second passages 1327*a*, 1327*b*.

The first passage 1327*a* is concavely disposed on one surface of at least one of the sub bearing 132 or the main bearing 131, and one side thereof may communicate with the compression space V to receive a pressure from the compression space V.

In embodiments disclosed herein, mainly, an example is shown in which the first and second passages 1327*a*, 1327*b* are disposed in the sub bearing 132, for example, a sub plate portion 1321 described hereinafter; however, embodiments are not necessarily limited thereto, and the first and second passages 1327*a*, 1327*b* may be provided in one of the sub bearing 132 or the main bearing 131 or both of the sub bearing 132 and the main bearing 131.

The first passage 1327*a* may be a groove having a predetermined width and depth, and disposed in a radial direction. The second passage 1327*b* may be disposed to pass through one surface of at least one of the sub bearing 132 or the main bearing 131 to provide a pressure provided from the first passage 1327*a* to be provided to the intermediate back pressure pocket 1325*b*.

In order to have a structure in which the second passage 1327*b* communicates with the first passage 1327*a*, when the first passage 1327*a* is disposed in the sub bearing 132, the second passage 1327*b* must also be connected to the sub bearing 132, and when the first passage 1327*a* is disposed in the main bearing 131, the second passage 1327*b* must also be formed on the main bearing 131. In addition, one side of the second passage 1327*b* is provided on one surface of the sub bearing 132, and may be spaced apart from the first passage 1327*a*. For example, the second passage 1327*b* may be provided in the sub plate portion 1321 of the sub bearing 132 described hereinafter.

Referring to FIGS. 3 and 4, an example is shown in which the first passage 1327*a* is concavely disposed on an upper surface of the sub bearing 132, and more particularly, an example is shown in which one (first) side of the first passage 1327*a* is disposed at a position in communication with the compression space V on an inner periphery of the cylinder 133, and the other (second) side thereof is disposed to communicate with the third passage 1327*c* described hereinafter. In addition, as shown in FIGS. 3 and 4, an example is shown in which the first passage 1327*a* is disposed at a position in communication with the compression space V at one position opposite to a proximal point P1 in contact between an outer peripheral surface 1341 of the roller 134 and an inner peripheral surface 1332 of the cylinder 133.

The pressure supply passage 1327 may further include the third passage 1327*c*. The third passage 1327*c* is provided on one surface of the roller 134, and may provide communication between the first and second passages 1327*a*, 1327*b* to supply a pressure provided from the first passage 1327*a* to the second passage 1327*b*. The third passage 1327*c* may be formed along a circumferential direction on one surface of the roller 134.

FIG. 4 shows an example in which the third passage 1327*c* is spaced apart on a lower end surface of the roller 134 along a circumferential direction, and is configured as three arc-shaped grooves. As shown in FIGS. 3 and 4, the third passage 1327*c* is spaced apart on the lower end surface of the roller 134 along the circumferential direction, and therefore, when the third passage 1327*c* is disposed between the first and second passage 1327*a*, 1327*b* as shown in FIG. 3, the first and second passages 1327*a*, 1327*b*, may communicate with each other through the third passage 1327*c*. On the contrary, when the third passage 1327*c* is not disposed between the first and second passages 1327*a*, 1327*b*, and portions spaced from one another are disposed between the plurality of third passages 1327*c*, the first and second passages 1327*a*, 1327*b* have a structure of not communicating with each other.

As described above, the rotary compressor 100 according to an embodiment may provide a pressure of the compression space V to the intermediate back pressure pocket 1325*b* through the first to third passages 1327*a*, 1327*bb*, 1327*c* of the pressure supply passage 1327, thereby improving contact friction loss and wear reliability acting on the front ends of the vanes 1351, 1352, 1353.

In FIG. 3, a flow provided to the intermediate back pressure pocket 1325*b* through the first to third passages 1327*a*, 1327*bb*, 1327*c* in the compression space V is represented by arrows.

In FIGS. 4 to 7, an example is shown in which the first passage 1327*a* and the second passage 1327*b* are disposed only in the sub bearing 132. However, the first passage 1327*a* and the second passage 1327*b* may not be disposed in the sub bearing 132, but may be formed only in the main bearing 131, and may also disposed in both the sub bearing 132 and the main bearing 131.

In a case in which the first and second passages 1327*a*, 1327*b* are disposed in the main bearing 131, as in a case in which the first and second passages 1327*a*, 1327*b* are disposed in the sub bearing 132, one (first) side of the second passage 1327*b* may be spaced apart from the first passage 1327*a* on one surface of the main bearing 131. As the third passage 1327*c* must have a structure that can be disposed between the first and second passages 1327*a*, 1327*b*, when the first and second passages 1327*a*, 1327*b* are disposed in the sub bearing 132, the third passage 1327*c* is disposed on one surface of the roller 134 facing the sub bearing 132, and when the first and second passages 1327*a*, 1327*b* are disposed in the main bearing 131, the third passage 1327*c* must be disposed on one surface of the roller 134 facing the main bearing 131.

On the other hand, a plurality of grooves having a same shape as that of the third passage 1327*c* may be provided on the other surface opposite to one surface of the roller 134, and the third passage 1327*c* and a groove having the same shape as that of the third passage 1327*c* may be disposed to be symmetrical on different surfaces of the roller 134. Referring to FIG. 4, the groove having the same shape as that of the third passage 1327*c* may be a gas balance distribution groove 1328.

When the first and second passages 1327*a*, 1327*b* are disposed only on one of the main bearing 131 and the sub bearing 132, the third passage 1327*c* must be disposed on one surface of the roller 134 facing the first and second passages 1327*a*, 1327*b*, and the gas balance distribution groove 1328 may be disposed on the other surface of the roller 134.

Referring to FIG. 4, an example is shown in which the first and second passages 1327*a*, 1327*b* are disposed only on the sub bearing 132, and the third passage 1327*c* is provided on a lower surface of the roller 134 (enlarged view of FIG. 4), and the gas balance distribution groove 1328 is provided on an upper surface of the roller 134. The gas balance distribution groove 1328 may have a same shape as that of the third passage 1327*c*, and be disposed on the other surface opposite to one surface on which the third passage 1327*c* is disposed. Due to the gas balance distribution groove 1328, it may be possible to prevent in advance an unbalance of force due to the third passage 1327*c* which is disposed only one surface of the roller 134 such that gas fills only the one surface of the roller 134 on one (first) side only.

FIG. 4 shows an example of the gas balance distribution groove 1328 disposed on an upper surface of the roller 134 in the shape of a plurality of spaced-apart grooves disposed in the same circumferential direction as that of the third passage 1327*c*. However, although not shown in the drawing, when the first and second passages 1327*a*, 1327*b* are disposed in both the main bearing 131 and the sub bearing 132, the third passage 1327*c* must be provided on upper and lower end surfaces of the roller 1327*c*, and a problem of the unbalance of force due to gas that fills only one surface of the roller 134 does not occur even when the gas balance distribution groove 1328 is not provided.

The second passage 1327*b* may include, for example, a first hole 1327*b*1 and a second hole 1327*b*2. The first hole 1327*b*1 may pass from one surface of at least one of the sub bearing 132 or the main bearing 131 toward an inside thereof. The second hole 1327*b*2 may intersect the first hole 1327*b*1, and one (first) side thereof may communicate with the first hole 1327*b*1 and the other (second) side thereof may communicate with the intermediate back pressure pocket 1325*b*.

Referring to FIGS. 4 to 7, an example is shown of the first hole 1327*b*1 disposed to pass from an upper surface of the sub bearing 132 toward an inside thereof, and the second hole 1327*b*2 disposed in a vertical direction to communicate with a lower side of the first hole 1327*b* so as to communicate with the intermediate back pressure pocket 1325*b*. One (first) side of the first hole 1327*b*1 provided on one surface of at least one of the sub bearing 132 or the main bearing 131 may be spaced apart from the first passage 1327*a*.

FIGS. 4 to 7 show an example in which one side of the first hole 1327*b*1 provided on an upper surface of the sub bearing 132 is spaced apart from the first passage 1327*a* to define a V-shape as a whole. The first passage 1327*a* may be spaced apart from the second passage 1327*b* by allowing one (first) side of the first hole 1327*b*1 provided on an upper surface of the sub bearing 132 to be spaced apart from the first passage 1327*a,* and the first passage 1327*a* and the second passage 1327*b* may communicate with each other through the third passage 1327*c*.

Figure 9:
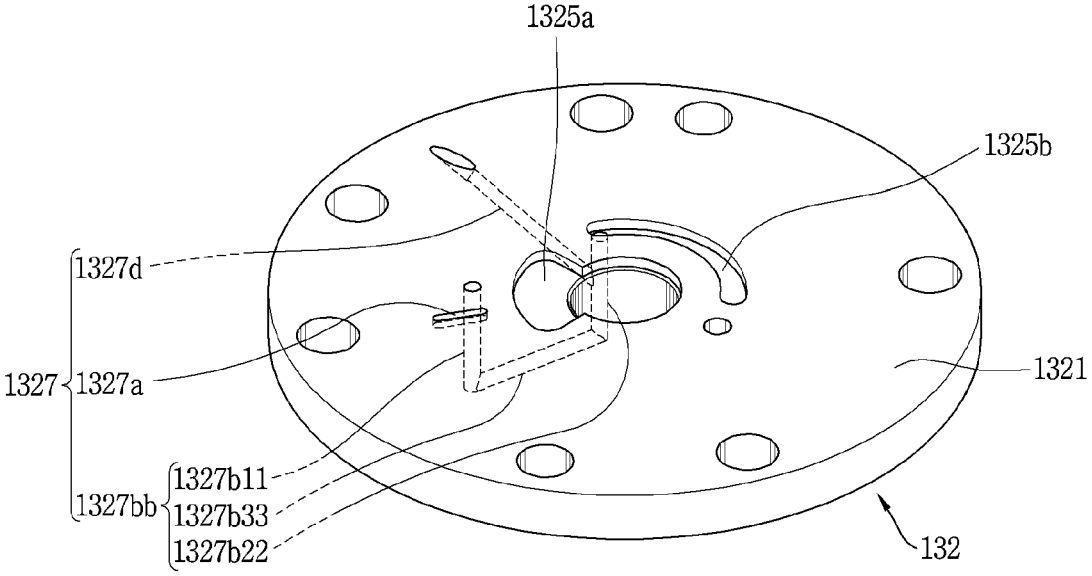
FIG. 9 is a perspective view of a sub bearing having a second passage according to another embodiment.

FIG. 9 is a perspective view of the sub bearing 132 provided with a second passage 1327*bb* according to another embodiment. Referring to FIG. 9, for another example, the second passage 1327*bb* may include first to third holes 1327*b*11, 1327*b*22, 1327*b*33.

According to an example in which the second passage 1327*bb* includes the first to third holes 1327*b*11, 1327*b*22, 1327*b*33, the first hole 1327*b*11 may be disposed to pass from one surface of at least one of the sub bearing 132 or the main bearing 131 toward an inside thereof, the second hole 1327*b*22 may be spaced apart from the first hole 1327*b*11 to be in parallel thereto, and one (first) side of the second hole 1327*b*22 may communicate with the intermediate back pressure pocket 1325*b,* and the third hole 1327*b*33 may be disposed to intersect the first hole 1327*b*11 and the second hole 1327*b*22, respectively, to communicate between the first hole 1327*b*11 and the second hole 1327*b*22.

As described above, in the rotary compressor 100 according to an embodiment, the pressure supply passage 1327 may include first to third holes 1327*b*11, 1327*b*22, 1327*b*33, and the pressure of the compression space V may be provided to the intermediate back pressure pocket 1325*b* through the first to third passages 1327*a,* 1327*bb,* 1327*c,* thereby improving contact friction loss and wear reliability acting on the front ends of the vanes 1351, 1352, 1353. On the other hand, referring to FIGS. 3, 4 and 6, the pressure supply passage 1327 may further include a fourth passage 1327*d*.

The fourth passage 1327*d* may allow the microseism reduction chamber 1335 and the intermediate back pressure pocket 1325*b* to communicate with each other in such a manner that one (first) side thereof is provided on one surface of the sub bearing 132 to communicate with the microseism reduction chamber 1335, and the other (second) side thereof is connected to the second passage 1327*b*. As described above, the microseism reduction chamber 1335 may be provided in the cylinder 133, and the microseism reduction chamber 1335 may be understood as a space for reducing the microseism of a pressure of the compression space V. The microseism reduction chamber 1335 may have a space of a preset or predetermined volume, and may communicate with the intermediate back pressure pocket 1325*b* through the fourth passage 1327*d*.

Referring to FIG. 3, an example is shown of the microseism reduction chamber 1335 which is disposed along the circumferential direction on the left side of the compression space V and disposed to pass through one surface the vertical direction, and one (first) side of an upper left portion of the fourth passage 1327*d* provided on one surface of the sub bearing 132 communicates with the microseism reduction chamber 1335. The fourth passage 1327*d* may communicate with the second hole 1327*b*2 of the second passage 1327*b,* and an example thereof is shown in FIGS. 4 and 7, for example.

In addition, as shown in FIG. 3, as the fourth passage 1327*d* has a relatively narrow passage compared to a volume of the microseism reduction chamber 1335, when a compression cycle is repeated while the roller 134 rotates a plurality of times, microseism occurring in the compression space V is moved to the microseism reduction chamber 1335 through the fourth passage 1327*d,* and is reduced in the microseism reduction chamber 1335.

Figure 10:
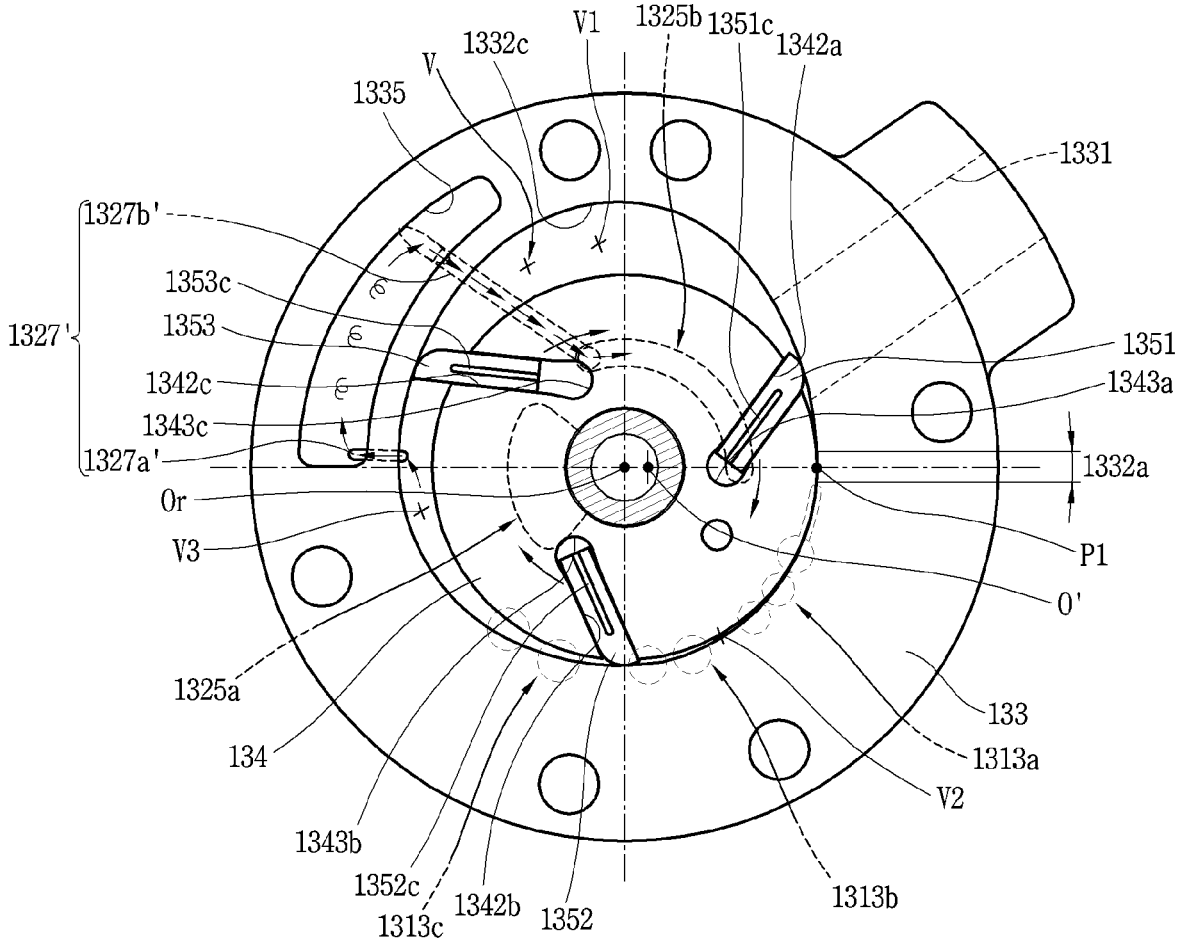
FIG. 10 is a perspective view of a pressure supply passage according to another embodiment.
Figure 11:
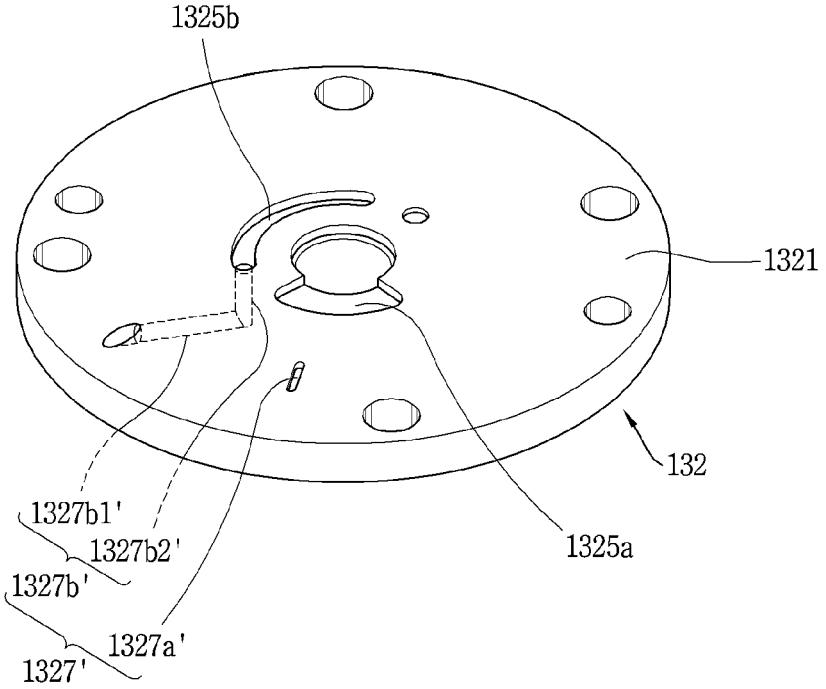
FIG. 11 is a plan view of a pressure supply passage according to another embodiment.
Figure 12:
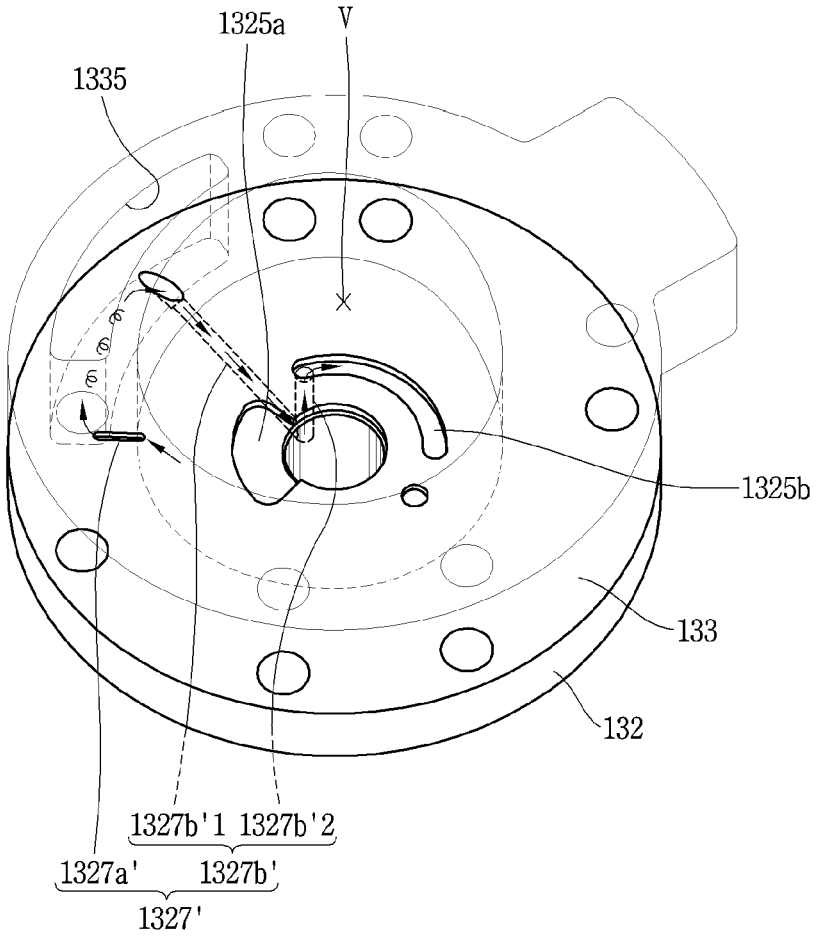
FIG. 12 is a perspective view in which an upper portion of a sub bearing provided with the pressure supply passage of FIGS. 10 and 11 is viewed from one side.

FIG. 10 is a perspective view of the pressure supply passage according to another embodiment. FIG. 11 is a plan view of a pressure supply passage according to another embodiment. FIG. 12 is a perspective view in which an upper portion of the sub bearing 132 provided with the pressure supply passage 1327 of FIGS. 10 and 11 is viewed from one side.

Hereinafter, with reference to FIGS. 10 to 12, the pressure supply passage 1327' of this embodiment will be described. The pressure supply passage 1327' according to this embodiment is different from the pressure supply passage 1327 of the previous embodiment in that one side of each of first and second passages 1327*a*', 1327*b*' is disposed in the microseism reduction chamber 1335.

The pressure supply passage 1327' of this embodiment may include the first and second passages 1327*a*', 1327*b*'. The first passage 1327*a*' may be concavely disposed on one surface of at least one of the sub bearing 132 and the main bearing 131, and one (first) side thereof may communicate with the compression space V to receive a pressure from the compression space V, and the other (second) side thereof may communicate with the microseism reduction chamber 1335. In addition, the second passage 1327*b*' may be disposed to pass through one surface of at least one of the sub bearing 132 or the main bearing 131 so as to communicate with the microseism reduction chamber 1335, and disposed to provide a pressure in the microseism reduction chamber 1335 to the intermediate back pressure pocket 1325*b*. Referring to FIGS. 10 to 12, an example is shown in which the first passage 1327*a*' is disposed on an upper surface of the sub bearing 132, and the second passage 1327*b*' is disposed to pass through the upper surface of the sub bearing 132, and provides communication between the microseism reduction chamber 1335 and the intermediate back pressure pocket 1325*b*.

The second passage 1327*b*' may include first and second holes 1327*b*1', 1327*b*2'. The first hole 1327*b*1' may pass from one surface of at least one of the sub bearing 132 or the main bearing 131 toward an inside thereof. The second hole 1327*b*2' may intersect the first hole 1327*b*1', and one (first) side thereof may communicate with the first hole 1327*b*1' and the other (second) side thereof may communicate with the intermediate back pressure pocket 1325*b*.

Referring to FIGS. 10 and 12, an example is shown in which the first hole 1327*b*1' passes from an upper surface of the sub bearing 132 toward an inside thereof, and a lower side of the second hole 1327*b*2' communicates with a lower end of the first hole 1327*b*1', and an upper side thereof communicates with the intermediate back pressure pocket 1325*b*. Referring to FIGS. 10 to 12, the configuration of the second passage 1327*b*' including the first and second holes 1327*b*1', 1327*b*2' in this embodiment is partially different from that of the first and second holes 1327*b*1, 1327*b*2 in the previous embodiment, but an overall shape thereof has a structure of passing through the sub bearing 132 in a V-shape to be similar to the previous embodiment.

Referring to FIG. 10, the microseism reduction chamber 1335 may be provided in the cylinder 133, and the microseism reduction chamber 1335 may be understood as a space for reducing the microseism of a pressure of the compression space V. The microseism reduction chamber 1335 may have a space of a preset or predetermined volume to communicate with the first and second passages 1327*a*', 1327*b*', and the pressure of the compression space V may be provided to the intermediate back pressure pocket 1325*b* through the first and second passages 1327*a*', 1327*b*' while reducing microseism.

Referring to FIG. 10, an example is shown of the microseism reduction chamber 1335 which is disposed along a circumferential direction on the left side of the compression space V and disposed to pass therethrough in a vertical direction, and one side on the left side of the second passage 1327*b*' provided to pass therethrough on an upper surface of the sub bearing 132 communicates with the microseism reduction chamber 1335. As shown in FIG. 10, when the compression cycle is repeated while the roller 134 rotates a plurality of times, the pressure of the compression space V moves into the microseism reduction chamber 1335 through the first passage 1327*a* to reduce microseism, and the pressure with the reduced microseism moves to the intermediate back pressure pocket 1325*b* through the second passage 1327*b*'.

In FIG. 12, a flow in which the pressure of the compression space V is introduced into the microseism reduction chamber 1335 through the first passage 1327*a*', and the pressure with reduced microseism is provided again to the intermediate back pressure pocket 1325*b* through the first and second holes 1327*b*1', 1327*b*2' of the second passage 1327*b*' is represented by arrows.

Figure 13:
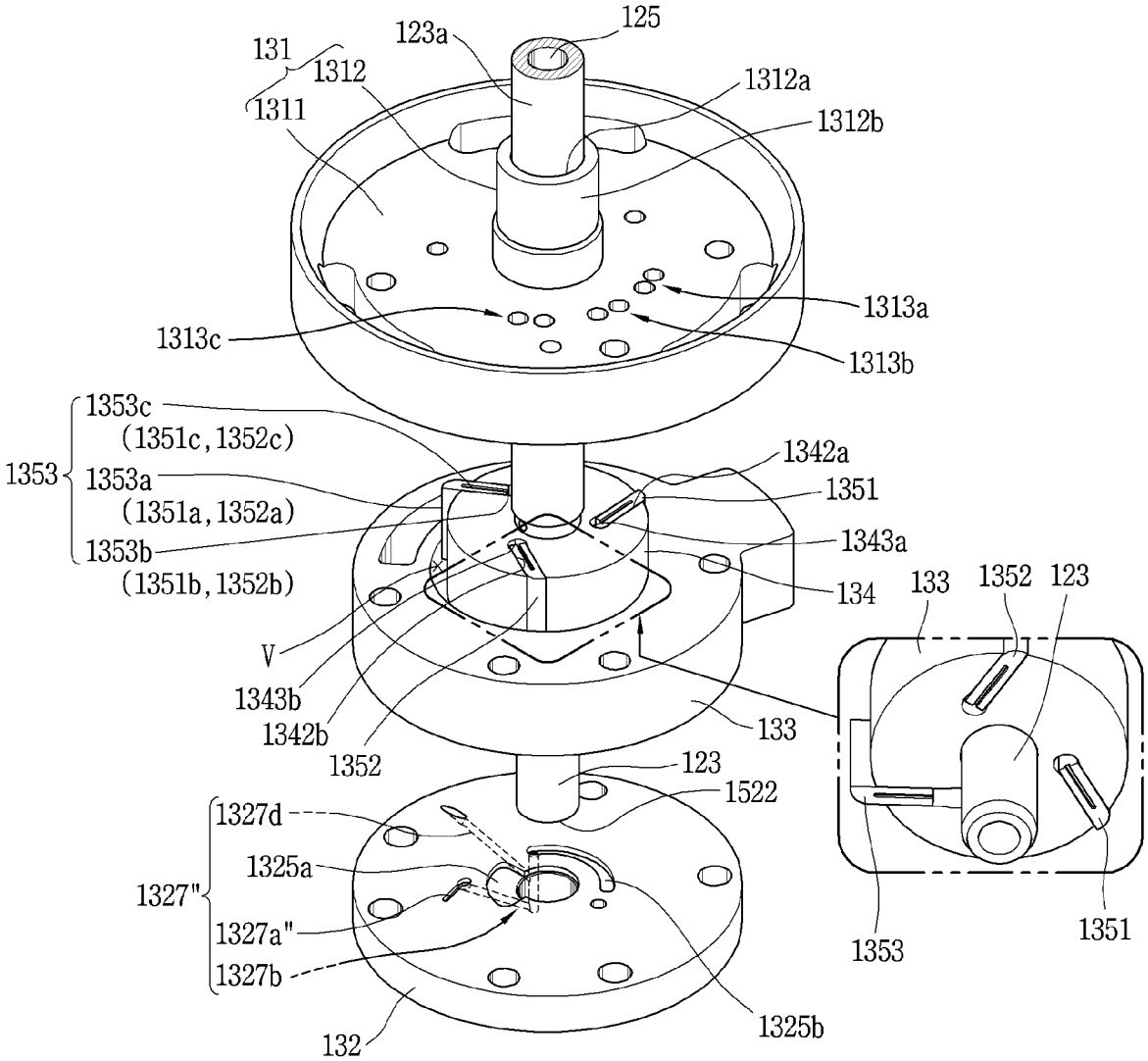
FIG. 13 is an exploded perspective view of a compression unit of a rotary compressor including a pressure supply passage according to yet another embodiment.
Figure 14:
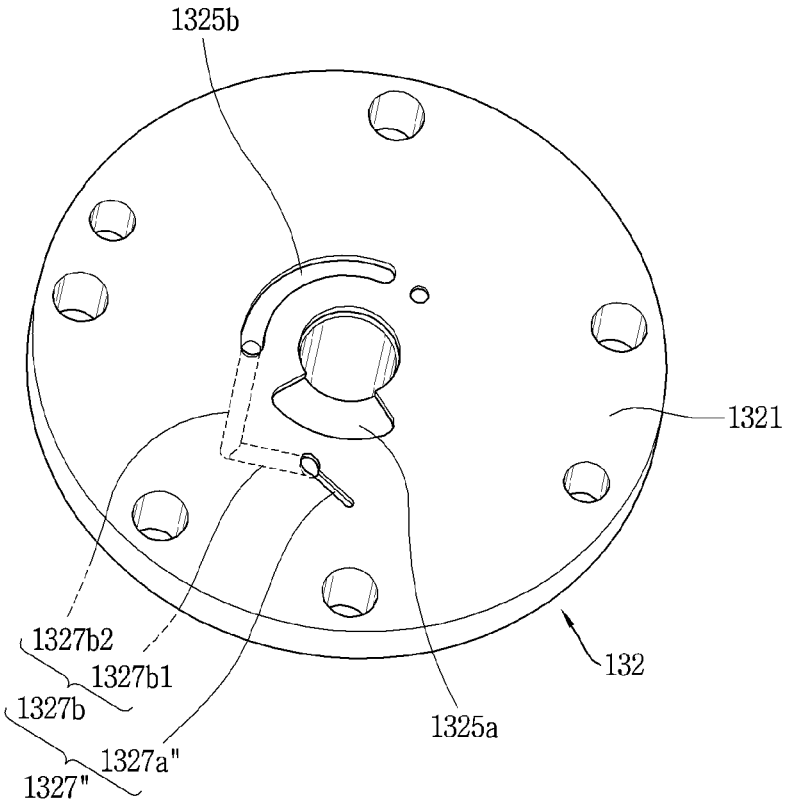
FIG. 14 is a perspective view in which an upper portion of a sub bearing provided with the pressure supply passage according to yet another embodiment is viewed from one side.
Figure 15:
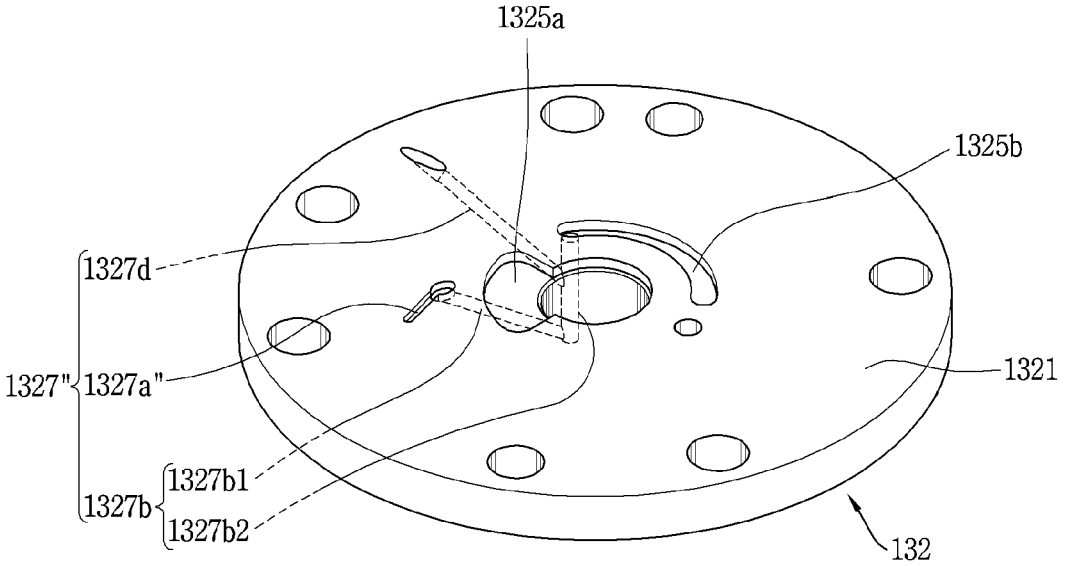
Figure 16:
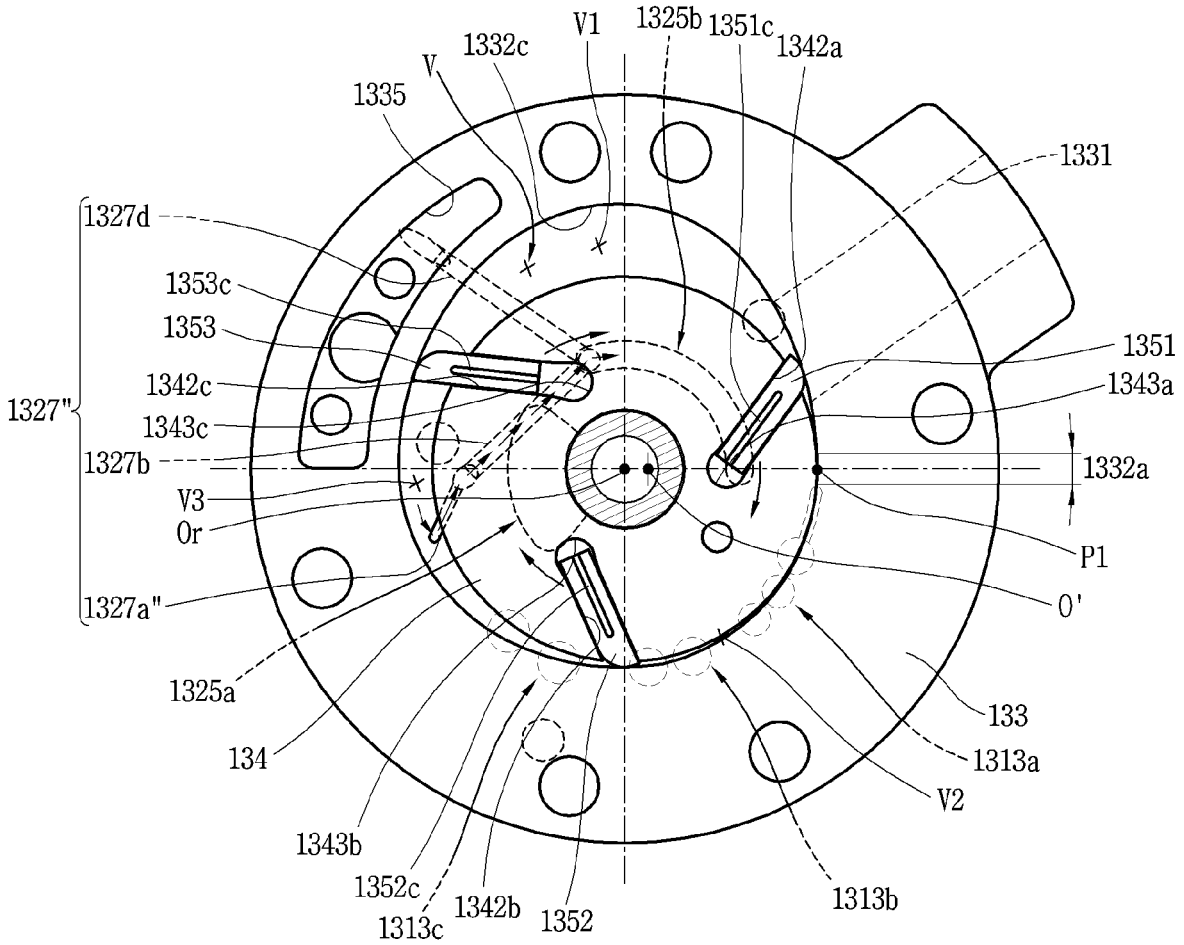
FIG. 16 is a transverse cross-sectional view of a compression unit of a rotary compressor according to an embodiment including the pressure supply passage of FIG. 13.

FIG. 13 is an exploded perspective view showing a compression unit of a rotary compressor including a pressure supply passage according to still another embodiment. FIG. 14 is a perspective view in which an upper portion of a sub bearing provided with the pressure supply passage of FIG. 13 is viewed from one side. FIG. 15 is a perspective view in which FIG. 14 is viewed from the other side, and FIG. 16 is a transverse cross-sectional view of a compression unit of a rotary compressor according to an embodiment including the pressure supply passage of FIG. 13.

Hereinafter, with reference to FIGS. 13 to 16, pressure supply passage 1327" according to this embodiment will be described.

Referring to FIGS. 13 to 16, pressure supply passage 1327" according to this embodiment may have a structure in which the first and second passages 1327*a*, 1327*b* directly communicate. As described above, as for the pressure supply passage in the previous embodiment, the first and second passages communicate with each other by the third passage, and on the contrary, as shown in FIG. 13, the pressure supply passage 1327" in this embodiment has a structure in which the first and second passages 1327*a*, 1327*b* directly communicate, and is different from the pressure supply passage in the previous embodiment in that the third passage is not disposed in the roller 134. Further, referring to FIGS. 13 to 16, an example is shown in which one side of the first passage 1327*a* is disposed to overlap with one side of the second passage 1327*b*.

The pressure supply passage 1327" of this embodiment may include first and second passages 1327*a*", 1327*b*. The first passage 1327*a*" in this embodiment may be concavely disposed on one surface of at least one of the sub bearing 132 or the main bearing 131, and one (first) side thereof may communicate with the compression space V to receive a pressure from the compression space V, and the other (second) side thereof may communicate with the second passage 1327*b*. Further, the second passage 1327*b* may pass through one surface of at least one of the sub bearing 132 or the main bearing 131 to provide a pressure provided through the first passage 1327*a*" in the compression space V to the intermediate back pressure pocket 1325*b*.

Referring to FIGS. 13 to 16, an example is shown in which the first passage 1327*a*" is disposed on an upper surface of the sub bearing 132, and the second passage 1327*b* passes through the upper surface of the sub bearing 132, and provides communication between the first passage 1327*a*" and the intermediate back pressure pocket 1325*b*.

Referring to FIG. 15, the second passage 1327*b* may include first and second holes 1327*b*1, 1327*b*2. The first hole 1327*b*1 may pass from one surface of at least one of the sub bearing 132 or the main bearing 131 toward an inside thereof, and may communicate with the first passage 1327*a*". The second hole 1327*b*2 may intersect the first hole 1327*b*1, and one (first) side thereof may communicate with the first hole 1327*b*1 and the other (second) side thereof may communicate with the intermediate back pressure pocket 1325*b*.

Referring to FIGS. 14 and 15, an example is shown in which the first hole 1327*b*1 passes from an upper surface of the sub bearing 132 toward an inside thereof, and a lower side of the second hole 1327*b*2 communicates with a lower end of the first hole 1327*b*1, and an upper side thereof communicates with the intermediate back pressure pocket 1325*b*. Referring to FIGS. 14 and 15, the configuration of the second passage 1327*b* including the first and second holes 1327*b*1, 1327*b*2 in this embodiment is the same as first and second holes 1327*b*1, 1327*b*2 in the previous embodiment, and an overall shape thereof also has a structure of passing through the sub bearing 132 in a V-shape, which is the same as the previous embodiment.

As shown in FIG. 13, when a compression cycle is repeated while the roller 134 rotates a plurality of times, the pressure of the compression space V passes through the first passage 1327*a*" and passes through the second passage 1327*b* communicated therewith and moves to the intermediate back pressure pocket 1325*b*.

In FIG. 16, a flow in which a pressure of the compression space V is provided to the intermediate back pressure pocket 1325*b* through the first passage 1327*a*" and the second passage 1327*b* is represented by arrows. On the other hand, referring to FIG. 16, the cylinder 133 may be provided with the microseism reduction chamber 1335 having a space of a preset or predetermined volume to communicate with the intermediate back pressure pocket 1325*b* so as to reduce the microseism of the pressure of the compression space V.

An example in which the pressure supply passage 1327" further includes the fourth passage 1327*d* that allows the microseism reduction chamber 1335 and the intermediate back pressure pocket 1325*b* to communicate with each other, one (first) side of which is provided on one surface of the sub bearing 132, and the other (second) side of which is connected to the second passage 1327*b* is shown in FIGS. 15 and 16.

Figure 17:
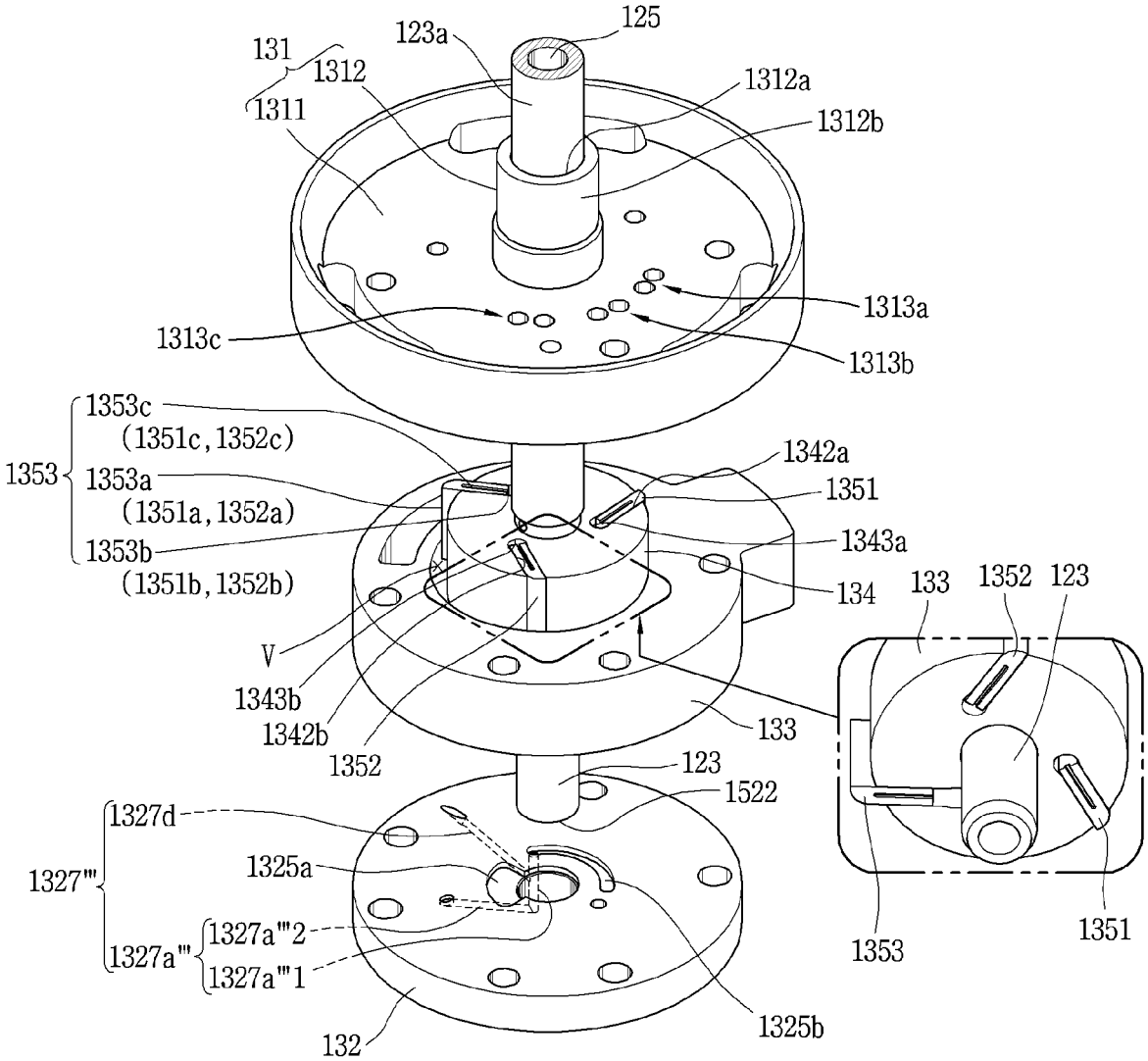
FIG. 17 is an exploded perspective view of a compression unit of a rotary compressor including a pressure supply passage according to still another embodiment.
Figure 18:
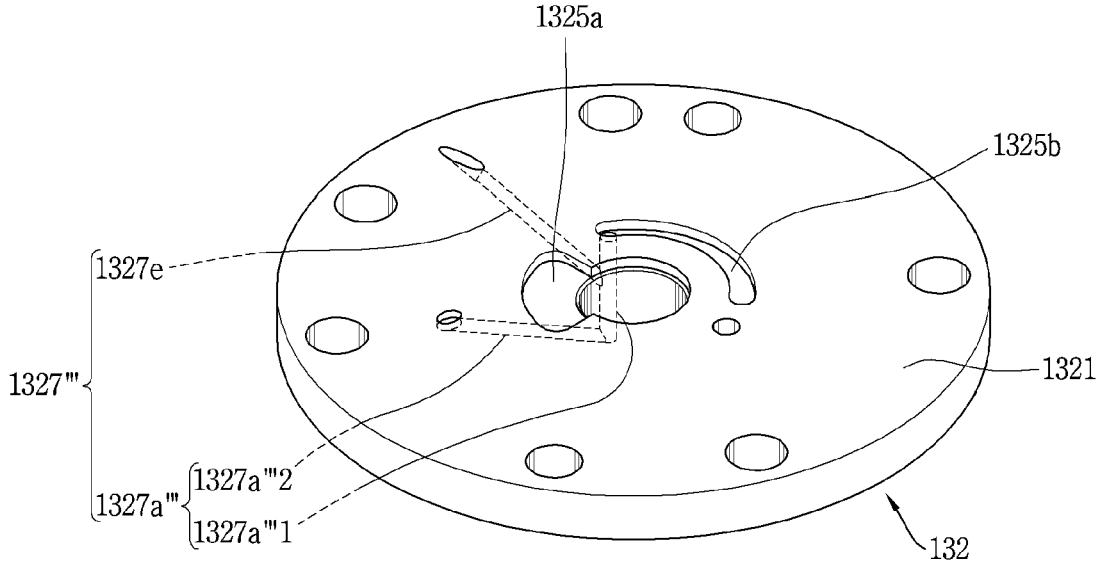
FIG. 18 is a perspective view in which an upper portion of a sub bearing provided with the pressure supply passage of FIG. 17 is viewed from one side.

FIG. 17 is an exploded perspective view of a compression unit of a rotary compressor including a pressure supply passage according to still another embodiment. FIG. 18 is a perspective view in which an upper portion of the sub bearing provided with the pressure supply passage according the embodiment of FIG. 17 is viewed from one side, and FIG. 19 is a transverse cross-sectional view showing a compression unit of a rotary compressor according to an embodiment including the pressure supply passage of FIG. 17.

Figure 19:
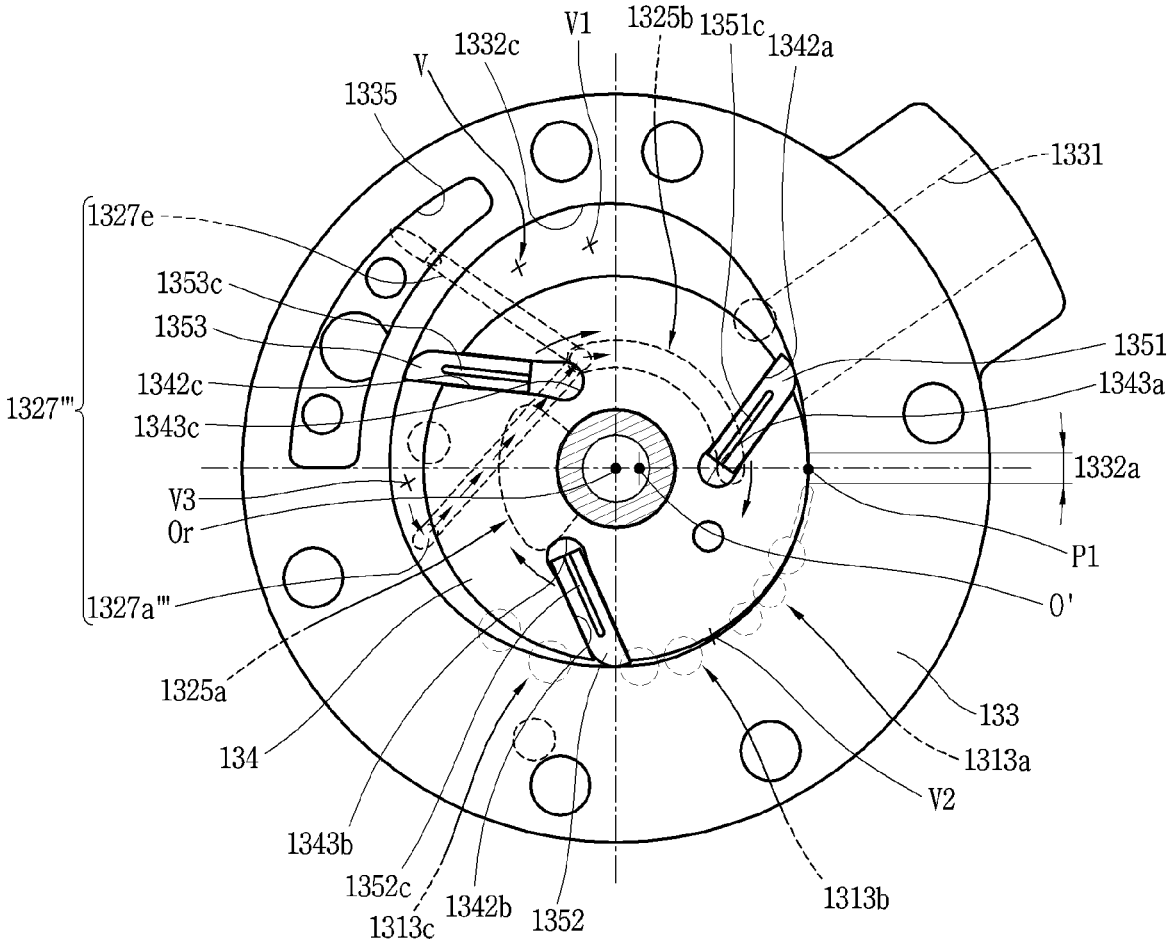
FIG. 19 is a transverse cross-sectional view of a compression unit of a rotary compressor according to an embodiment including the pressure supply passage of FIG. 17.

Referring to FIGS. 17 to 19, the pressure supply passage 1327'" of this embodiment includes a first passage 1327*a*'" disposed to pass through one surface of at least one of the sub bearing 132 or the main bearing 131 and disposed to provide a pressure provided from the compression space V to the intermediate back pressure pocket 1325*b*. Further, the first passage 1327*a*" passes from one surface of at least one of the sub bearing 132 or the main bearing 131 toward an inside thereof, and one side thereof may include a first hole 1327*a*'"1 that communicates with the compression space V; and a second hole 1327*a*'"2 disposed to intersect the first hole 1327*a*'"1, one (first) side of which communicates with the first hole 1327*a*'"1 and the other (second) side of which communicates with the intermediate back pressure pocket 1325*b*.

As described above, for the pressure supply passage 1327, the first and second passages communicate with each other by the third passage, and on the contrary, as shown in FIG. 18, the pressure supply passage 1327" in this embodiment has a structure in which the first passage 1327*a*'" provides direct communication between the back pressure pocket 1325*b* and the compression space V, and is different from the pressure supply 1327 in that the third flow path is not formed in the roller 134.

Referring to FIG. 18, the first passage 1327*a*'" may include first and second holes 1327*a*'"1, 1327*a*'"2. Referring to FIGS. 18 and 19, the configuration of the first passage 1327*a*'" including the first and second holes 1327*a*'"1, 1327*a*'"2 in this embodiment is different from the first and second holes 1327*b*1, 1327*b*2 of the pressure supply passage 1327 as the first hole 1327*a*'"1 must communicate directly with the compression space V, and an overall shape thereof has a structure of passing through the sub bearing 132 in a V-shape, which is the same as the first embodiment.

As shown in FIG. 19, when a compression cycle is repeated while the roller 134 rotates a plurality of times, the pressure of the compression space V passes through the first passage 1327*a*'" and moves to the intermediate back pressure pocket 1325*b*. In addition, in FIG. 19, a flow in which a pressure of the compression space V is provided to the intermediate back pressure pocket 1325*b* through the first passage 1327*a*'" is represented by arrows.

Further, referring to FIGS. 18 and 19, the cylinder 133 may be provided with the microseism reduction chamber 1335 having a space of a preset or predetermined volume to communicate with the intermediate back pressure pocket 1325*b* so as to reduce the microseism of the pressure of the compression space V.

In addition, an example in which the pressure supply passage 1327'" further includes the second passage 1327*d* that allows the microseism reduction chamber 1335 and the intermediate back pressure pocket 1325*b* to communicate with each other, one (first) side of which is provided on one surface of the sub bearing 132, and the other (second) side of which is connected to the first hole 1327*a*'"1 is shown in FIGS. 18 and 19. As shown in FIG. 19, as the second passage 1327*e* has a relatively narrow passage compared to a volume of the microseism reduction chamber 1335, when the compression cycle is repeated while the roller 134 rotates a plurality of times, microseism occurring in the compression space V to communicate with the intermediate back pressure pocket 1325*b* is moved to the microseism reduction chamber 1335 through the second passage 1327*e*, and is reduced in the microseism reduction chamber 1335.

Again, referring to FIG. 1, the rotary compressor 100 according to an embodiment may further include casing 110 and drive motor 120. The drive motor 120 may be provided in upper inner space 110*a* of the casing 110, and the compression unit 130 in lower inner space 110*d* of the casing 110, respectively, and the drive motor 120 and the compression unit 130 may be connected by rotational shaft 123.

The casing 110, which is a portion constituting an exterior of the compressor, may be divided into a vertical or horizontal type depending on an aspect of installing the compressor. The vertical type has a structure in which the drive motor 120 and the compression unit 130 are disposed at both upper and lower sides along an axial direction, and the horizontal type has a structure in which the drive motor 120 and the compression unit 130 are disposed at both left and right sides. In embodiments disclosed herein, the casing 110 is mainly described with a vertical shape.

The casing 110 may include intermediate shell 111 defined in a cylindrical shape, lower shell 112 that covers a lower end of the intermediate shell 111, and upper shell 113 that covers an upper end of the intermediate shell 111. The drive motor 120 and the compression unit 130 may be inserted into and fixedly coupled to the intermediate shell 111, and suction pipe 115 may be passed therethrough to be directly connected to the compression unit 130. The lower shell 112 is sealingly coupled to a lower end of the intermediate shell 111, and storage oil space 110*b* in which oil to be supplied to the compression unit 130 is stored may be disposed below the compression unit 130. The upper shell 113 is sealingly coupled to an upper end of the intermediate shell 111, and oil separation space 110*c* may be disposed above the drive motor 120 to separate oil from refrigerant discharged from the compression unit 130.

The drive motor 120, which is a portion constituting the electric motor unit, provides power to drive the compression unit 130. The drive motor 120 includes stator 121, rotor 122, and the rotational shaft 123. The stator 121 may be fixedly provided inside of the casing 110, and may be, for example, press-fitted and fixed to an inner peripheral surface of the casing 110 by a method, such as shrink fitting. For example, the stator 121 may be press-fitted and fixed to an inner peripheral surface of the intermediate shell 111.

The rotor 122 is rotatably inserted into the stator 121, and the rotational shaft 123 is, for example, press-fitted and coupled to a center of the rotor 122. Accordingly, the rotational shaft 123 rotates concentrically together with the rotor 122.

Oil passage 125 is defined in a hollow hole shape at the center of the rotational shaft 123, and oil through holes 126*a*, 126*b* are disposed to pass therethrough toward an outer peripheral surface of the rotational shaft 123 in a middle of the oil passage 125. The oil through holes 126*a*, 126*b* include first oil through hole 126*a* belonging to a range of a main bush portion 1312, and second oil through hole 126*b* belonging to a range of a second bearing portion, which will be described hereinafter. Each of the first oil through hole 126*a* and the second oil through hole 126*b* may be configured by one or a plurality. This embodiment shows an example that is configured by a plurality of oil through holes.

An oil pickup 127 may be provided in or at a middle or at a lower end of the oil passage 125. For example, the oil pickup 127 may include one of a gear pump, a viscous pump, or a centrifugal pump. This embodiment shows an example to which a centrifugal pump is applied. Accordingly, when the rotational shaft 123 rotates, oil filled in the oil storage space 110*b* of the casing 110 may be pumped by the oil pickup 127, and the oil may be suctioned up along the oil passage 125 and then supplied to sub bearing surface 1322*b* of sub bush portion 1322 through second oil through hole 126*b*, and to main bearing surface 1312*b* of main bush portion 1312 through first oil through hole 126*a*.

Further, the rotational shaft 123 may be integrally formed with the roller 134, which will be described hereinafter, or the roller 134 may be press-fitted and post-assembled thereto. In this embodiment, an example will be mainly described in which the roller 134 is integrally formed with the rotational shaft 123, but the roller 134 will be described hereinafter.

In the rotational shaft 123, a first bearing support surface may be disposed at an upper half portion of the rotational shaft 123 with respect to the roller 134, that is, between a main shaft portion 123*a* press-fitted into the rotor 122 and main bearing portion 131 extending toward the roller 134 from the main shaft portion 123*a* formed between the bearing portions 123*b*, and a second bearing support surface may be disposed at a lower half portion of the rotational shaft 123 with respect to the roller 134, that is, at a lower end of the sub bearing portion 123*c* of the rotational shaft 123. The first bearing support surface constitutes a first axial support portion 151 together with a first shaft support surface described hereinafter, and the second bearing support surface constitutes a second shaft support portion 152 together with a second shaft support surface described hereinafter. The first bearing support surface and the second bearing support surface will be described hereinafter together with the first axial support portion 151 and the second axial support portion 152.

The compression unit 130 may be understood as a configuration including the main bearing 131, the sub bearing 132, the cylinder 133, the roller 134, and the plurality of vanes 1351, 1352, 1353. The main bearing 131 and the sub bearing 132 are provided at both upper and lower sides of the cylinder 133, respectively, to constitute the compression space V together with the cylinder 133, the roller 134 is rotatably provided in the compression space V, the vanes 1351, 1352, 1353 are slidably inserted into the roller 134, the plurality of vanes 1351, 1352, 1353 respectively, come into contact with the inner periphery of the cylinder 133, and the compression space V is partitioned into a plurality of compression chambers.

Referring to FIGS. 1 to 3, the main bearing 131 may be fixedly provided at the intermediate shell 111 of the casing 110. For example, the main bearing 131 may be inserted into and welded to the intermediate shell 111.

The main bearing 131 may be closely coupled to an upper end of the cylinder 133. Accordingly, the main bearing 131 defines an upper surface of the compression space V, and supports an upper surface of the roller 134 in an axial direction, and at the same time, supports an upper half portion of the rotational shaft 123 in a radial direction.

The main bearing 131 may include main plate portion 1311 and main bush portion 1312. The main plate portion 1311 is coupled to the cylinder 133 so as to cover an upper side of the cylinder 133, and the main bush portion 1312 extends in an axial direction from a center of the main plate portion 1311 toward the drive motor 120 to support an upper half portion of the rotational shaft 123. The main plate portion 1311 may be defined in a disk shape, and an outer peripheral surface of the main plate portion 1311 may be closely fixed to an inner peripheral surface of the intermediate shell 111.

For example, it has been described above that the pressure supply passage 1327 is disposed in at least one of the main bearing 131 or the sub bearing 132, but when the pressure supply passage 1327 is disposed in the main bearing 131, the first and second passages 1327*a*, 1327*b* of the pressure supply passage 1327 may be disposed in the main plate portion 1311.

The first passage 1327*a* may be a groove having a predetermined width and depth on one surface facing the roller 134 of the main plate portion 1311, and disposed in a radial direction. Further, as described above, one side of the first passage 1327*a* communicates with the compression space V on an inner periphery of the cylinder 133 to receive a pressure from the compression space V. The second passage 1327*b* may be disposed to pass through one surface facing the roller 134 of the main plate portion 1311 to provide a pressure provided from the first passage 1327*a* to the intermediate back pressure pocket 1325*b*.

When the first and second passages 1327*a*, 1327*b* are disposed in the main plate portion 1311 of the main bearing 131, the third passage 1327*c* may be disposed on an upper surface of the roller 134 to communicate with the first and second passages 1327*a*, 1327*b*. As described above, the third passage 1327*c* may provide communication between the first and second passages 1327*a*, 1327*b* to supply a pressure provided from the first passage 1327*a* to the second passage 1327*b*, but the third passage 1327*c* may be disposed along a circumferential direction on the upper surface of the roller 134.

At least one discharge port 1313*a*, 1313*b*, 1313*c* may be disposed in the main plate portion 1311, a plurality of discharge valves 1361, 1362, 1363 may be provided at an upper surface of the main plate portion 1311 to open and close each discharge port 1313*a*, 1313*b*, 1313*c*, and a discharge muffler 137 having a discharge space (no reference numeral) may be provided at an upper side of the main plate portion 1311 to accommodate the discharge ports 1313*a*, 1313*b*, 1313*c* and the discharge valves 1361, 1362, 1363. The discharge port will be described hereinafter.

A discharge back pressure pocket (not shown) and an intermediate back pressure pocket 1315*a* (FIG. 1) may be disposed on a lower surface of the main plate portion 1311 facing an upper surface of the roller 134 between both side surfaces of the main plate portion 1311 in the axial direction. In embodiments disclosed herein, the discharge back pressure pocket and the intermediate back pressure pocket 1315*a* (FIG. 1) disposed on a lower surface of the main plate portion 1311 may have the same shape as those of the discharge back pressure pocket 1325*a* and the intermediate back pressure pocket 1325*b*, respectively, disposed on an upper surface of the sub plate portion 1321.

The discharge back pressure pocket and the intermediate back pressure pocket 1315*a* of the main plate portion 1311 may be disposed in an arc shape at a predetermined interval along a circumferential direction. An inner peripheral surface of the discharge back pressure pocket and the intermediate back pressure pocket 1315*a* of the main plate portion 1311 may be defined in a circular shape, and an outer peripheral surface thereof may be defined in an elliptical shape in consideration of the vane slots 1342*a*, 1342*b*, 1342*c* described hereinafter.

The discharge back pressure pocket and the intermediate back pressure pocket 1315*a* of the main plate portion 1311 may be disposed within an outer diameter range of the roller 134. Accordingly, the discharge back pressure pocket and the intermediate back pressure pocket 1315*a* of the main plate portion 1311 may be separated from the compression space V. However, unless a separate sealing member is provided between a lower surface of the main plate portion 1311 and an upper surface of the roller 134 facing the lower surface of the main plate portion 1311, the discharge back pressure pocket and the intermediate back pressure pocket 1315*a* of the main plate portion 1311 may finely communicate through a gap between both surfaces.

The discharge back pressure pocket of the main plate portion 1311 forms a discharge pressure higher than that of the intermediate back pressure pocket 1315*a*, and the intermediate back pressure pocket 1315*a* forms an intermediate pressure between a suction pressure and a discharge pressure. In the discharge back pressure pocket of the main plate portion 1311, oil (refrigerant oil) may pass through a micro-channel between a main bearing protrusion 1316*a*, which will be described hereinafter, and an upper surface 134*a* of the roller 134 to flow into the back pressure pocket of the main plate portion 1311. The intermediate back pressure pocket 1315*b* may be defined within a range of the compression chamber defining an intermediate pressure in the compression space V. In particular, when the pressure supply passage 1327 is disposed in the main bearing 131, the intermediate back pressure pocket 1315*a* receives the pressure of the compression space V through the pressure supply passage 1327 to maintain an intermediate pressure.

The intermediate back pressure pocket 1315*a* of the main plate portion 1311 forms a lower pressure, for example, an intermediate pressure, compared to that of the discharge back pressure pocket of the main plate portion 1311. In the intermediate back pressure pocket 1315*a*, oil flowing into main bearing hole 1312*a* of the main bearing 131 through the first oil through hole 126*a* may flow into the intermediate back pressure pocket 1315*a*.

Further, on an inner periphery side of the discharge back pressure pocket and the intermediate back pressure pocket 1315*a* of the main plate portion 1311, the main bearing protrusion 1316*a* may be disposed to extend from the main bearing surface 1312*b* of the main bush portion 1312. Accordingly, the discharge back pressure pocket and the intermediate back pressure pocket 1315*a* of the main plate portion 1311 may be sealed to the outside, while at the same time stably supporting the rotational shaft 123.

The main bush portion 1312 may be disposed in a hollow bush shape, and a first oil groove 1312*c* may be disposed on an inner peripheral surface of the main bearing hole 1312*a* constituting an inner peripheral surface of the main bush portion 1312. The first oil groove 1312*c* may be defined in an oblique or spiral shape, for example, between upper and lower ends of the main bush portion 1312 such that the lower end thereof communicates with the first oil through hole 126*a*. Although not shown in the drawings, an oil groove may also be defined in a diagonal or spiral shape, for example, on an outer peripheral surface of the rotational shaft 123 in contact with an inner periphery of the main bush portion 1312.

Referring to FIGS. 1 to 3, the sub bearing 132 may be closely coupled to a lower end of the cylinder 133. Accordingly, the sub bearing 132 defines a lower surface of the compression space V, and supports a lower surface of the roller 134 in an axial direction, and at the same time supports a lower half portion of the rotational shaft 123 in a radial direction.

The sub bearing 132 may include sub plate portion 1321 and sub bush portion 1322. The sub plate portion 1321 is coupled to the cylinder 133 so as to cover a lower side of the cylinder 133, and the sub bush portion 1322 extends in an axial direction from a center of the sub plate portion 1321 toward the lower shell 112 to support a lower half portion of the rotational shaft 123. The sub plate portion 1321 may be defined in a disk shape similar to that of the main plate portion 1311, and an outer peripheral surface of the sub plate portion 1321 may be spaced apart from an inner peripheral surface of the intermediate shell 111.

For example, it has been described above that the pressure supply passage 1327 is disposed in at least one of the main bearing 131 or the sub bearing 132, but when the pressure supply passage 1327 is disposed in the sub bearing 132, the first and second passages 1327*a*, 1327*b* of the pressure supply passage 1327 may be disposed in the sub plate portion 1321. The first passage 1327*a* may be groove having a predetermined width and depth on one surface facing the roller 134 of the sub plate portion 1321, and disposed in a radial direction. Further, as described above, one side of the first passage 1327*a* communicates with the compression space V on an inner periphery of the cylinder 133 to receive a pressure from the compression space V. The second passage 1327*b* may be disposed to pass through one surface facing the roller 134 of the sub plate portion 1321 and disposed to provide a pressure provided from the first passage 1327*a* to the intermediate back pressure pocket 1325*b*.

A discharge back pressure pocket 1325*a* and an intermediate back pressure pocket 1325*b* may be disposed on an upper surface of the sub plate portion 1321 facing a lower surface of the roller 134 between both axial side surfaces of the sub plate portion 1321. The discharge back pressure pocket 1325*a* and the intermediate back pressure pocket 1325*b* of the sub plate portion 1321 may be disposed to be symmetrical about the roller 134 in the discharge back pressure pocket and the intermediate back pressure pocket 1315*a* of the main plate portion 1311 described above, respectively.

The discharge back pressure pocket and the intermediate back pressure pocket 1315*a* provided in the main bearing 131 may be symmetrically disposed in the discharge back pressure pocket 1325*a* and the intermediate back pressure pocket 1325*b*, respectively, provided in the sub bearing 132 with respect to the roller 134, but are not necessarily limited thereto, and may also be asymmetrically disposed. For example, the discharge back pressure pocket and the intermediate back pressure pocket 1315*a* provided in the main bearing 131 may be disposed to be deeper than the discharge back pressure pocket 1325*a* and the intermediate back pressure pocket 1325*b* provided in the sub bearing 132.

On the other hand, description of the discharge back pressure pocket 1325*a*, the intermediate back pressure pocket 1325*b*, and the sub bearing protrusion 1326*a* of the sub plate portion 1321, which are not described, may be the same as the description of the discharge back pressure pocket, the intermediate back pressure pocket 1315*a*, and the main bearing protrusion 1316*a* of the main plate portion 1311.

A first end constituting an inlet of the oil supply hole (not shown) may be disposed to be submerged in the oil storage space 110*b*, and a second end constituting an outlet of the oil supply hole may be disposed to be positioned on a rotational path of the back pressure chambers 1343*a*, 1343*b*, 1343*c*, which will be described hereinafter, on an upper surface of the sub plate portion 1321 facing a lower surface of the roller 134 described hereinafter. Accordingly, during rotation of the roller 134, high-pressure oil stored in the oil storage space 110*b* may be periodically supplied to the back pressure chambers 1343*a*, 1343*b*, 1343*c* through the oil supply hole (not shown) while the back pressure chambers 1343*a*, 1343*b*, 1343*c* periodically communicate with the oil supply hole (not shown), and through this, each of the vanes 1351, 1352, 1353 may be stably supported toward the inner peripheral surface 1332 of the cylinder 133.

The sub bush portion 1322 may be disposed in a hollow bush shape, and a second oil groove 1322*c* may be disposed on an inner peripheral surface of the sub bearing hole 1322*a* constituting an inner peripheral surface of the sub bush portion 1322. The second oil groove 1322*c* may be defined in a straight line or an oblique line between upper and lower ends of the sub bush portion 1322 such that the upper end thereof communicates with the second oil through hole 126*b* of the rotational shaft 123. Although not shown in the drawings, an oil groove may also be defined in a diagonal or spiral shape on an outer peripheral surface of the rotational shaft 1322 coupled to an inner periphery of the sub bush portion 123*b*.

The discharge ports 1313*a*, 1313*b*, 1313*c* may be disposed in the main bearing 131 as described above. However, the discharge ports may be disposed in the sub bearing 132 or may be disposed in the main bearing 131 and the sub bearing 132, respectively, and disposed to pass through between inner and outer peripheral surfaces of the cylinder 133. This embodiment will be mainly described using an example in which the discharge ports 1313*a*, 1313*b*, 1313*c* are disposed in the main bearing 131.

Only one discharge port 1313*a*, 1313*b*, 1313*c* may be disposed. However, in the discharge ports 1313*a*, 1313*b*, 1313*c* according to an embodiment, the plurality of the discharge ports 1313*a*, 1313*b*, 1313*c* may be disposed at a predetermined interval along a compression advancing direction (or a rotational direction of the roller 134).

In general, in the vane type rotary compressor 100, as the roller 134 is disposed eccentrically with respect to the compression space V, a proximal point P1 almost in contact between an outer peripheral surface 1341 of the roller 134 and an inner peripheral surface 1332 of the cylinder 133 is generated, and the discharge port 1313*a*, 1313*b*, 1313*c* is disposed in the vicinity of the proximal point P1. Accordingly, as the compression space V approaches the proximal point P1, a distance between the inner peripheral surface 1332 of the cylinder 133 and the outer peripheral surface 1341 of the roller 134 is greatly decreased, thereby making it difficult to secure an area for the discharge port.

As a result, as in this embodiment, the discharge port 1313*a*, 1313*b*, 1313*c* may be divided into a plurality of discharge ports 1313*a*, 1313*b*, 1313*c* to be defined along a rotational direction (or compression advancing direction) of the roller 134. Further, the plurality of discharge ports 1313*a*, 1313*b*, 1313*c* may be respectively defined one by one, but may be defined in pairs as in this embodiment.

For example, referring to FIG. 3, an example is shown in which the discharge ports 1313*a*, 1313*b*, 1313*c* according to this embodiment are arranged in order of first discharge port 1313*a*, second discharge port 1313*b*, and third discharge port 1313*c* from the discharge ports disposed relatively far from a proximal portion 1332*a*. According to the example shown in FIG. 3, the plurality of discharge ports 1313*a*, 1313*b*, 1313*c* may communicate with one compression chamber.

Although not shown in the drawings, a first gap between the first discharge port 1313*a* and the second discharge port 1313*b*, a second gap between the second discharge port 1313*b* and the third discharge port 1313*c*, and a third gap between the third discharge port 1313*c* and the first discharge port 1313*a* may be defined to be the same as one another. The first gap, the second gap, and the third gap may be defined to be substantially the same as a circumferential length of the first compression chamber V1, a circumferential length of the second compression chamber V2, and a circumferential length of the third compression chamber V3, respectively.

As such, the plurality of discharge ports 1313*a*, 1313*b*, 1313*c* may communicate with one compression chamber, and the plurality of compression chambers do not communicate with one discharge port 1313*a*, 1313*b*, 1313*c*, but the first discharge port 1313*a* may communicate with the first compression chamber V1, the second discharge port 1313*b* with the second compression chamber V2, and the third discharge port 1313*c* with the third compression chamber V3, respectively. However, when the vane slots 1342*a*, 1342*b*, 1342*c* described hereinafter are disposed at unequal intervals as in this embodiment, a circumferential length of each compression chamber V1, V2, V3 is formed differently, and in one compression chamber may communicate with a plurality of discharge ports, or a plurality of compression chambers may communicate with one discharge port.

Further, the plurality of discharge ports 1313*a*, 1313*b*, 1313*c* may be opened and closed by respective discharge valves 1361, 1362, 1363 described above. Each of the discharge valves 1361, 1362, 1363 may be configured with a cantilevered reed valve having one (first) end constituting a fixed end and the other (second) end constituting a free end. As each of these discharge valves 1361, 1362, 1363 is widely known in the rotary compressor 100 in the related art, detailed description thereof has been omitted.

Referring to FIGS. 1 to 3, the cylinder 133 according to this embodiment may be in close contact with a lower surface of the main bearing 131 and bolt-fastened to the main bearing 131 together with the sub bearing 132. As described above, as the main bearing 131 is fixedly coupled to the casing 110, the cylinder 133 may be fixedly coupled to the casing 110 by the main bearing 131.

The cylinder 133 may be defined in an annular shape having an empty space portion to form the compression space V in or at the center. The empty space portion may be sealed by the main bearing 131 and the sub bearing 132 to form the above-described compression space V, and the roller 134, which will be described hereinafter, may be rotatably coupled to the compression space V.

Referring to FIG. 2, the cylinder 133 may be defined such that suction port 1331 passes through inner and outer peripheral surfaces thereof. However, unlike FIG. 2, the suction port 1331 may be disposed to pass through inner and outer peripheral surfaces of the main bearing 131 or the sub bearing 132. The suction port 1331 may be disposed at one side in a circumferential direction around the proximal point P1 described hereinafter. The discharge ports 1313*a*, 1313*b*, 1313*c* described above may be disposed in the main bearing 131 at the other side in a circumferential direction opposite to the suction port 1331 around the proximal point P1.

The inner peripheral surface 1332 of the cylinder 133 may be defined in an elliptical shape. The inner peripheral surface 1332 of the cylinder 133 according to this embodiment may be defined in an asymmetric elliptical shape by combining a plurality of ellipses, for example, four ellipses having different major and minor ratios to have two origins. More specifically, the inner peripheral surface 1332 of the cylinder 133 according to this embodiment may be defined to have a first origin O, which is the rotational center of the roller 134, which will be described hereinafter, (an axial center or an outer diameter center of the cylinder 133), and a second origin O' that is biased toward a proximal point P1 with respect to the first origin O.

The X-Y plane defined around the first origin O defines a third quadrant Q3 and a fourth quadrant Q4, and the X-Y plane defined around the second origin O' defines a first quadrant Q1 and a second quadrant Q2. The third quadrant Q3 is defined by the third ellipse, the fourth quadrant Q4 by the fourth ellipse, respectively, and the first quadrant Q1 may be defined by the first ellipse, and the second quadrant Q2 by the second ellipse, respectively.

In addition, the inner peripheral surface 1332 of the cylinder 133 according to this embodiment may include a proximal portion 1332*a*, a distal portion 1332*b*, and a curved portion 1332*c*. The proximal portion 1332*a* is a portion closest to an outer peripheral surface of the roller 134 (or the rotational center 1341 of the roller 134), the distal portion 1332*b* is a portion farthest from the outer peripheral surface 1341 of the roller 134, and the curved portion 1332*c* is a portion connecting the proximal portion 1332*a* and the distal portion 1332*b*.

Referring to FIGS. 1 to 3, the roller 134 may be rotatably provided in the compression space V of the cylinder 133, and the plurality of vanes 1351, 1352, 1353, which will be described hereinafter, may be inserted at a predetermined interval into the roller 134 along a circumferential direction. Accordingly, compression chambers as many as the number of the plurality of vanes 1351, 1352, 1353 may be partitioned and defined in the compression space V. In this embodiment, an example will be mainly described in which the plurality of vanes 1351, 1352, 1353 are made up of three and the compression space V are partitioned into three compression chambers.

The roller 134 according to this embodiment has an outer peripheral surface 1341 defined in a circular shape, and the rotational shaft 123 may be extended as a single body or may be post-assembled and combined therewith at the rotational center Or of the roller 134. Accordingly, the rotational center Or of the roller 134 is coaxially positioned with respect to an axial center (unsigned) of the rotational shaft 123, and the roller 134 rotates concentrically together with the rotational shaft 123. Further, as the roller 134 rotates together by rotation of the rotational shaft 123, when the third passage 1327*c* of the roller 134 communicates with the first and second passages 1327*a*, 1327*b*, a pressure in the compression space V may be provided to the intermediate back pressure pocket 1325*b*.

However, as described above, as the inner peripheral surface 1332 of the cylinder 133 is defined in an asymmetric elliptical shape biased in a specific direction, the rotational center Or of the roller 134 may be eccentrically disposed with respect to an outer diameter center Oc of the cylinder 133. Accordingly, in the roller 134, one side of the outer peripheral surface 1341 is almost in contact with the inner peripheral surface 1332 of the cylinder 133, precisely, the proximal portion 1332*a*, to define the proximal point P1.

The proximal point P1 may be defined in the proximal portion 1332*a* as described above. Accordingly, an imaginary line passing through the proximal point P1 may correspond to a major axis of an elliptical curve defining the inner peripheral surface 1332 of the cylinder 133.

In addition, the roller 134 may have a plurality of vane slots 1342*a*, 1342*b*, 1342*c* disposed to be spaced apart from one another along a circumferential direction on the outer peripheral surface 1341 thereof, and the plurality of vanes 1351, 1352, 1353 described hereinafter may be slidably inserted into and coupled to the vane slots 1342*a*, 1342*b*, 1342*c*, respectively. The plurality of vane slots 1342*a*, 1342*b*, 1342*c* may be defined as first vane slot 1342*a*, second vane slot 1342*b*, and third vane slot 1342*c* along a compression advancing direction (rotational direction of the roller 134). The first vane slot 1342*a*, the second vane slot 1342*b*, and the third vane slot 1342*c* may be disposed to have a same width and depth at equal or unequal intervals along a circumferential direction.

For example, the plurality of vane slots 1342*a*, 1342*b*, 1342*c* may be respectively disposed to be inclined by a predetermined angle with respect to a radial direction so as to sufficiently secure lengths of the vanes 1351, 1352, 1353. Accordingly, when the inner peripheral surface 1332 of the cylinder 133 is defined in an asymmetric elliptical shape, even though a distance from the outer peripheral surface 1341 of the roller 134 to the inner peripheral surface 1332 of the cylinder 133 increases, the vanes 1351, 1352, 1353 may be 44 suppressed or prevented from being released from the vane slots 1342*a*, 1342*b*, 1342*c*, thereby increasing a ° of freedom in designing the inner peripheral surface 1332 of the cylinder 133.

Allowing a direction in which the vane slot 1342*a*, 1342*b*, 1342*c* is inclined to be an opposite direction to the rotational direction of the roller 134, that is, allowing the front end surface of each vane 1351, 1352, 1353 in contact with the inner peripheral surface 1332 of the cylinder 133 to be inclined toward the rotational direction of the roller 134 may be advantageous because a compression start angle may be pulled toward the rotational direction of the roller 134 to quickly start compression.

The back pressure chambers 1343*a*, 1343*b*, 1343*c* may be disposed to communicate with one another at inner ends of the vane slots 1342*a*, 1342*b*, 1342*c*. The back pressure chamber 1343*a*, 1343*b*, 1343*c* is a space in which refrigerant (oil) at a discharge pressure or intermediate pressure is accommodated toward a rear side of each vane 1351, 1352, 1353, that is, the vane rear end portion 1351*c*, 1352*c*, 1353*c*, and the each vane 1351, 1352, 1353 may be pressurized toward an inner peripheral surface of the cylinder 133 by a pressure of the oil (or refrigerant) filled in the back pressure chamber 1343*a*, 1343*b*, 1343*c*. For convenience, hereinafter, it will be described that a direction toward the cylinder 133 with respect to a movement direction of the vane 1351, 1352, 1353 is defined as a front side, and an opposite side thereto as a rear side.

Referring to FIGS. 1 to 3, the plurality of vanes 1351, 1352, 1353 according to this embodiment may be slidably inserted into the vane slots 1342*a*, 1342*b*, 1342*c*, respectively. Accordingly, the plurality of vanes 1351, 1352, 1353 may be defined to have substantially the same shape as the vane slots 1342*a*, 1342*b*, 1342*c*, respectively.

For example, the plurality of vanes 1351, 1352, 1353 may be defined as first vane 1351, second vane 1352, and third vane 1353 along the rotational direction of the roller 134. The first vane 1351 may be inserted into the first vane slot 1342*a*, the second vane 1352 into the second vane slot 1342*b*, and the third vane 1353 into the third vane slot 1342*c*, respectively.

The plurality of vanes 1351, 1352, 1353 may all have a same shape. More specifically, each of the plurality of vanes 1351, 1352, 1353 may be defined as a substantially rectangular parallelepiped, the front end surface 1351*a*, 1352*a*, 1353*a* in contact with the inner peripheral surface 1332 of the cylinder 133 may be defined as a curved surface, and the rear end surface 1351 b, 1352*b*, 1353*b* facing the respective back pressure chamber 1343*a*, 1343*b*, 1343*c* may be defined as a straight surface.

In the rotary compressor 100 provided with hybrid cylinder 133 as described above, when power is applied to the drive motor 120, the rotor 122 of the drive motor 120 and the rotational shaft 123 coupled to the rotor 122 rotate, and the roller 134 coupled to or integrally formed with the rotational shaft 123 rotates together with the rotational shaft 123. Then, the plurality of vanes 1351, 1352, 1353 are drawn out from the respective vane slots 1342*a*, 1342*b*, 1342*c* by a centrifugal force generated by rotation of the roller 134 and a back pressure of the back pressure chamber 1343*a*, 1343*b*, 1343*c* supporting the rear end surface 1351*b*, 1352*b*, 1353*b* of the vane 1351, 1352, 1353 to come into contact with the inner peripheral surface 1332 of the cylinder 133. Then, the compression space V of the cylinder 133 is partitioned into compression chambers (including suction chambers or discharge chambers) V1, V2, V3 as many as the number of the plurality of vanes 1351, 1352, 1353 by the plurality of vanes 1351, 1352, 1353, a volume of the respective compression chamber V1, V2, V3 is varied by a shape of the inner peripheral surface 1332 of the cylinder 133 and an eccentricity of the roller 134, and refrigerant suctioned into the respective compression chamber V1, V2, V3 is compressed and discharged into an inner space of the casing 110 while moving along the roller 134 and the vane 1351, 1352, 1353.

As described above, in the rotary compressor in the related art, as formation of the intermediate back pressure chamber pressure is formed by a suction or compression chamber pressure and a discharge pressure, the effect of the discharge pressure is relatively higher than the suction or compression chamber pressure, and an excessive back pressure is applied to the front ends of the vanes, thereby resulting in a decrease in efficiency due to friction loss at the front ends of the vanes, as well as leading to a decrease in wear reliability to cause product quality problems. Accordingly, in this embodiment, the intermediate back pressure pocket 1325*b* for providing a back pressure at an intermediate pressure to at least one of the main bearing 131 or the sub bearing 132 is provided, and the main back pressure pocket 1325*b* is provided, and the pressure supply passage 1327 capable of providing the pressure of the compression space V to the intermediate back pressure pocket 1325*b* may be configured with a plurality of passages in at least one of the main bearing 131 or the sub bearing 132.

Through this, a discharge pressure intermediate back pressure structure may be improved to a compression chamber pressure adaptive intermediate back pressure structure, thereby improving contact friction loss and wear reliability acting on the front ends of the vanes 1351, 1352, 1353. Moreover, it may be possible to suppress generation of chattering noise during an initial start-up through the improvement of sensitivity to the back pressure formation of the vanes 1351, 1352, 1353 during the start-up. Further, when the compression cycle is repeated while the roller 134 rotates a plurality of times due to the microseism reduction chamber 1335, and a relatively narrow passage compared to a volume of the microseism reduction chamber 1335 connected thereto, microseism generated in the compression space V may be moved to the microseism reduction chamber 1335, and reduced in the microseism reduction chamber 1335.

Figure 20:
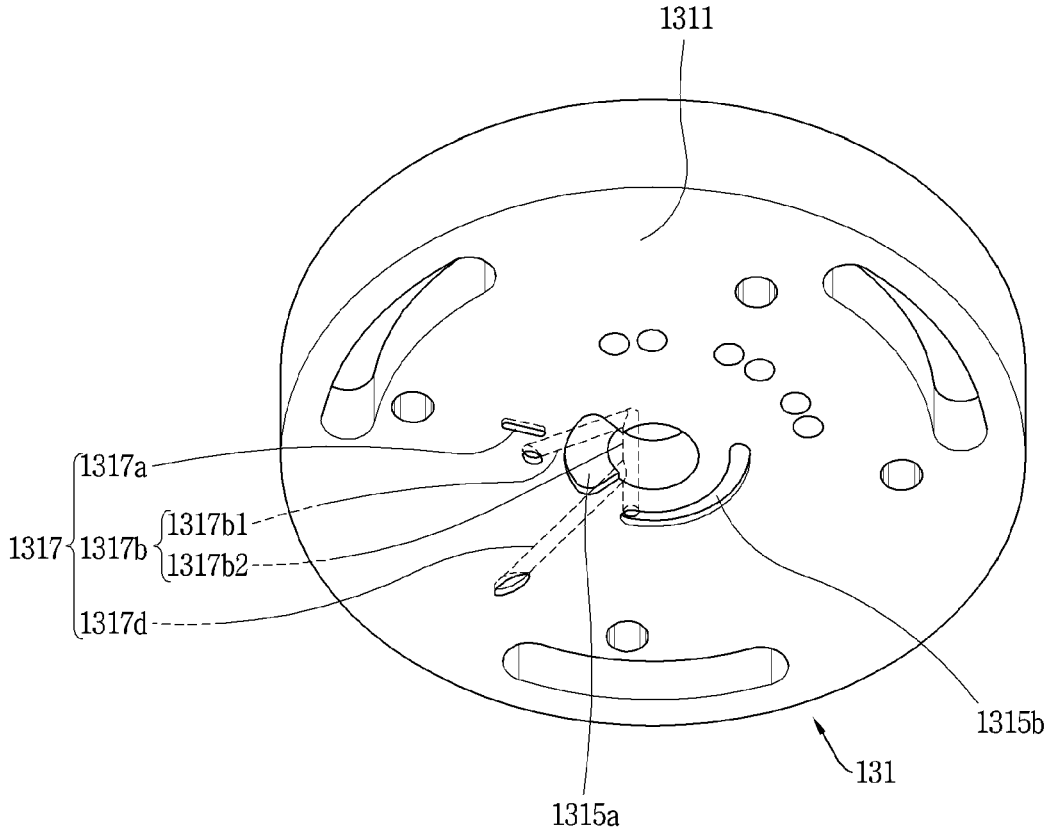
FIG. 20 is a perspective view of a pressure supply passage provided in a main bearing according to an embodiment.
Figure 21:
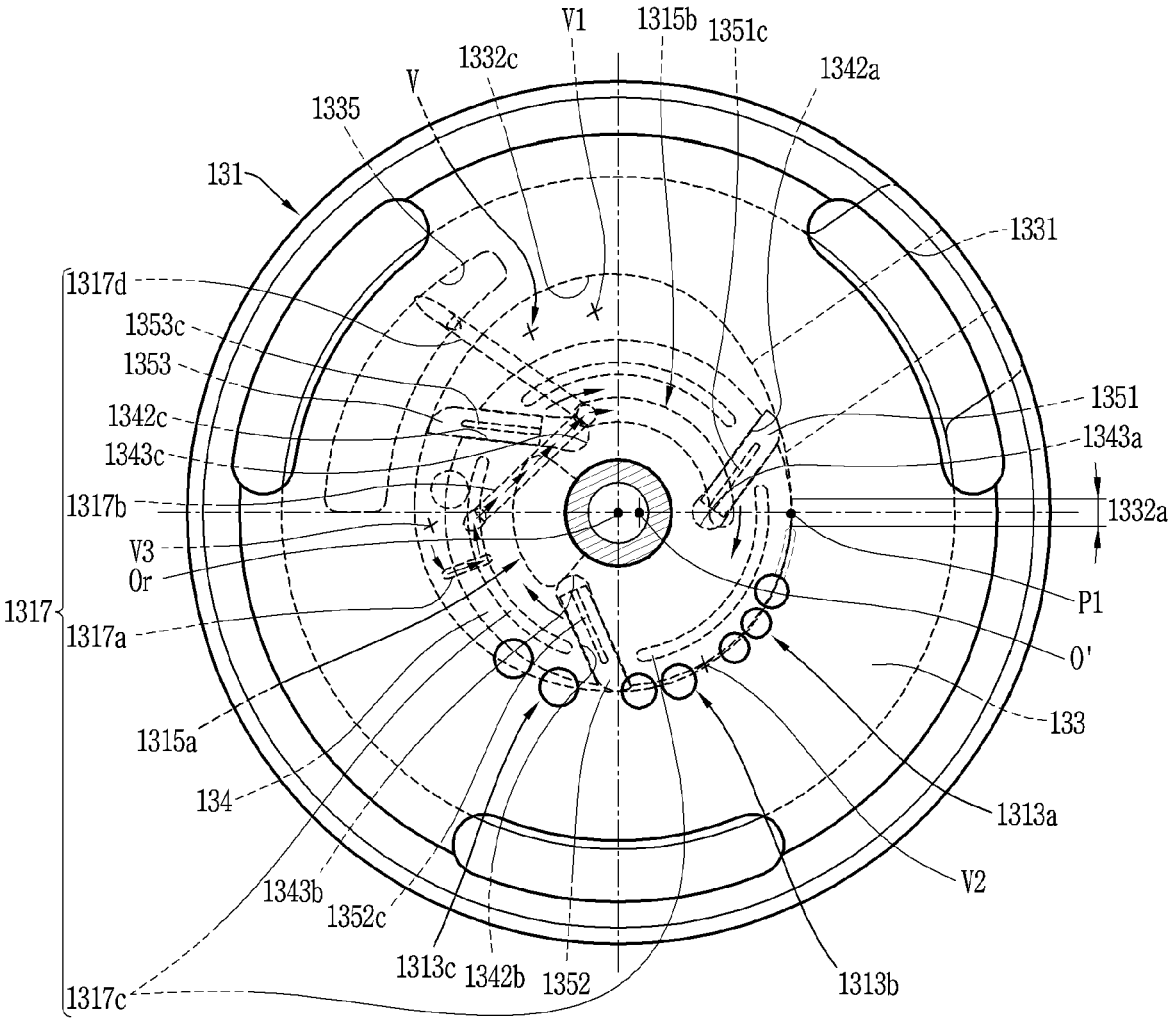
FIG. 21 is a transverse cross-sectional view of a compression unit in which the pressure supply passage of FIG. 20 is provided in a main bearing.
Figure 22:
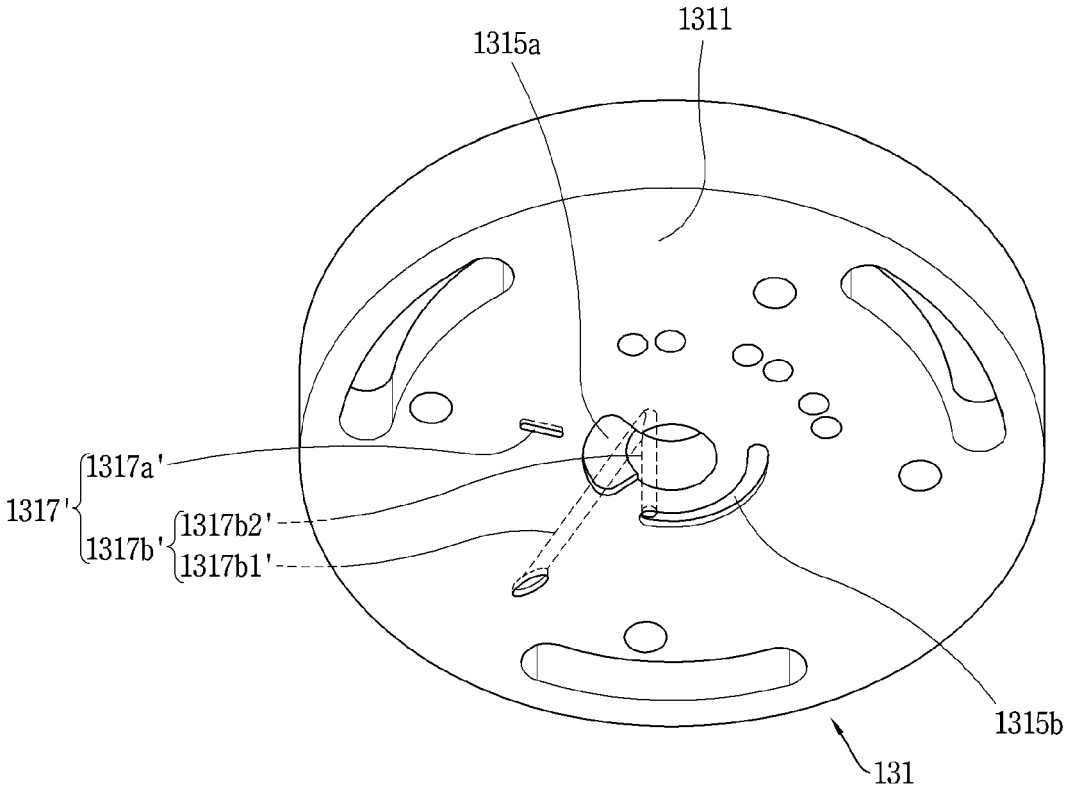
FIG. 22 is a perspective view of a pressure supply passage according to another embodiment provided in a main bearing.
Figure 23:
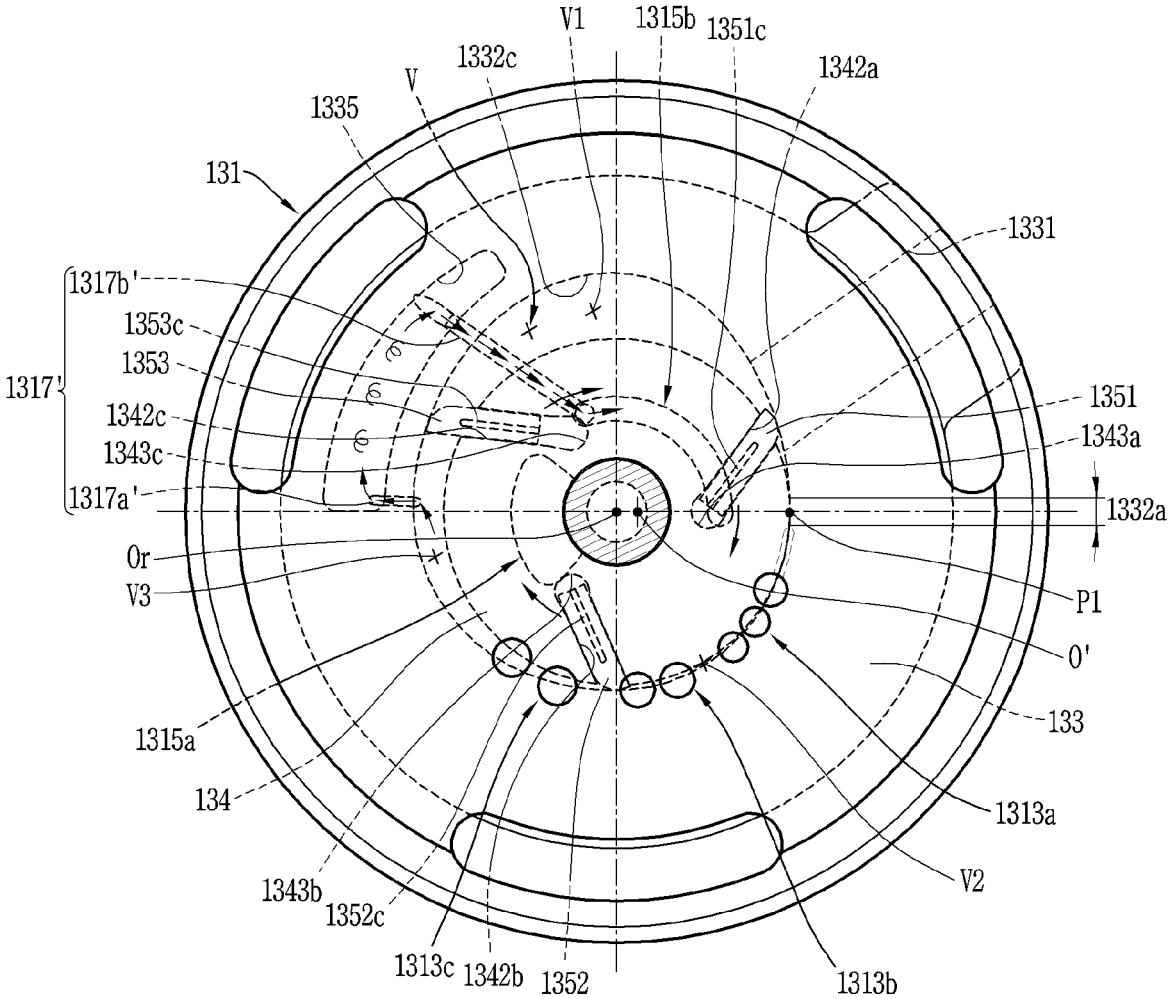
FIG. 23 is a transverse cross-sectional view of a compression unit in which the pressure supply passage of FIG. 22 is provided in a main bearing according to an embodiment.
Figure 24:
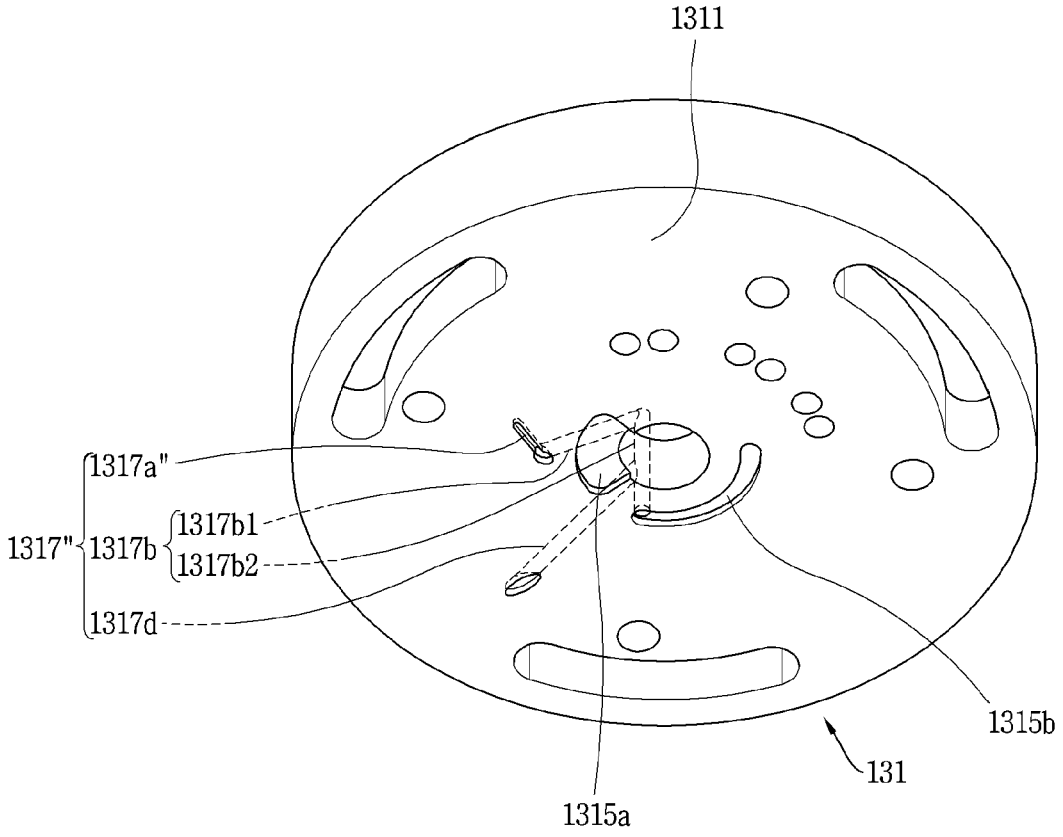
FIG. 24 is a perspective view of a pressure supply passage according to another embodiment provided in a main bearing.
Figure 25:
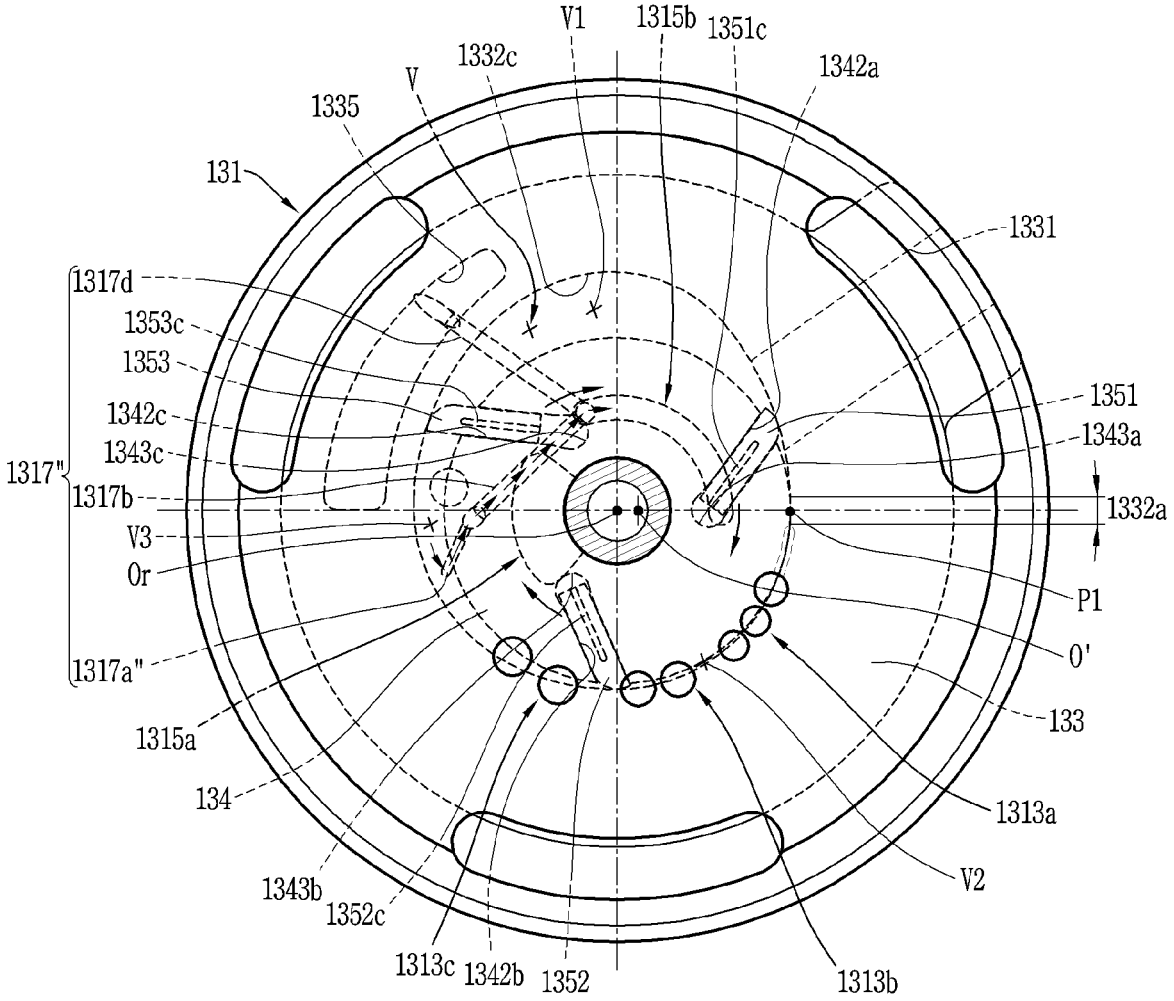
FIG. 25 is a cross-transverse sectional view of a compression unit in which the pressure supply passage of FIG. 24 is provided in a main bearing according to an embodiment.
Figure 26:
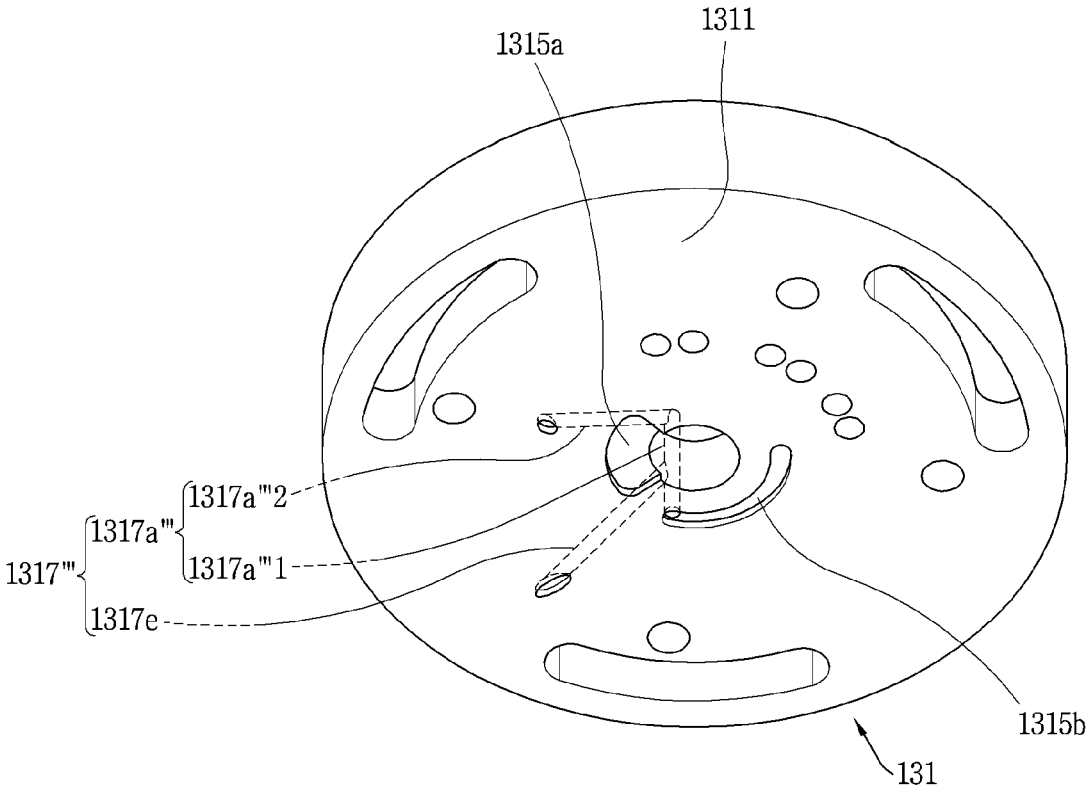
FIG. 26 is a perspective view of a pressure supply passage according to another embodiment provided in a main bearing.
Figure 27:
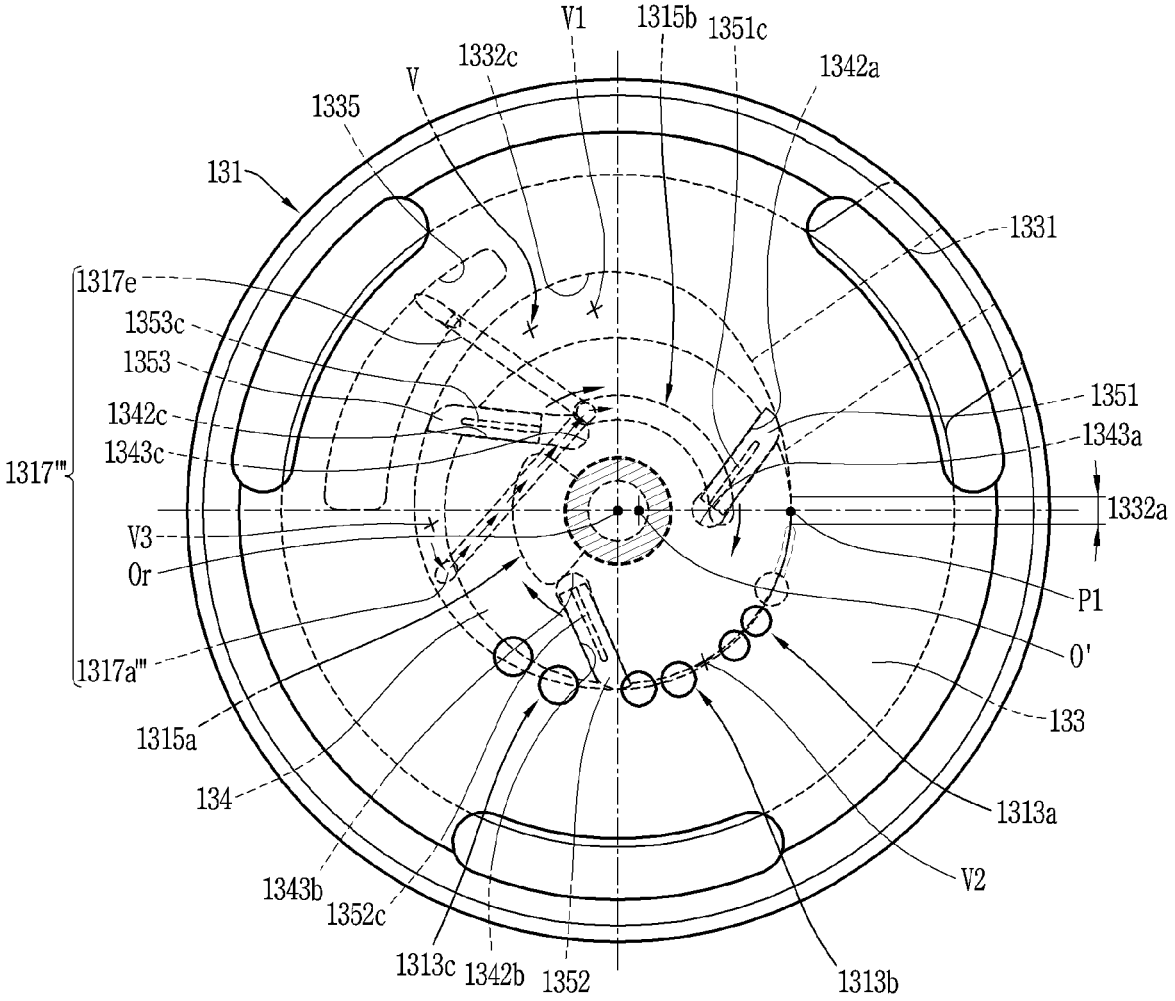
FIG. 27 is a transverse cross-sectional view of a compression unit in which the pressure supply passage of FIG. 26 is provided in a main bearing according to an embodiment.

FIG. 20 is a perspective view of the pressure supply passage provided in the main bearing. FIG. 21 is a transverse cross-sectional view of a compression unit in which the pressure supply passage of FIG. 20 is provided in the main bearing. FIG. 22 is a perspective view of a pressure supply passage according to another embodiment provided in the main bearing, and FIG. 23 is a transverse cross-sectional view showing a compression unit in which the pressure supply passage of FIG. 22 is provided in the main bearing. FIG. 24 is a perspective view of a pressure supply passage according to another embodiment provided in the main bearing, and FIG. 25 is a transverse cross-sectional view showing a compression unit in which the pressure supply passage of FIG. 24 is provided in the main bearing. FIG. 26 is a perspective view of a pressure supply passage according to another embodiment provided in the main bearing, and FIG. 27 is a transverse cross-sectional view showing a compression unit in which the pressure supply passage of FIG. 26 is provided in the main bearing.

Although an example in which the pressure supply passage of the various embodiments is mainly provided in the main bearing 131 has mainly been described, the pressure supply passage may be provided in at least one of the main bearing 131 or the sub bearing 132, and therefore, an example in which the pressure supply passage 1317, 1317', 1317", 1317'" of the various embodiments is provided in the main bearing 131 will be described hereinafter with reference to FIGS. 20 to 27.

As described above, according to embodiments disclosed herein, the pressure supply passage 1317 may be provided as one of the various embodiments, and there is a structural difference in which for the pressure supply passage 1317, the first and second passages 1317*a*, 1317*b* communicate through the third passage 1317*c* defined in the roller 134 without being connected through the microseism reduction chamber 1335, and on the other hand, for pressure supply passage 1317', the first and second passages 1317*a*, 1317*b* communicate through the microseism reduction chamber 1335. In addition, pressure supply passage 1317", which will be described hereinafter, has structure in which the first and second passages 1317*a*, 1317*b* directly communicate, and pressure supply passage 1317'", which will be described hereinafter, has structure in which a compression space and the intermediate back pressure pocket 1315*b* communicate via a single passage.

Hereinafter, with reference to FIGS. 20 and 21, the pressure supply passage 1317 in which the first and second passages 1317*a*, 1317*b* communicate through the third passage 1317*c* defined on the roller 134 will be described. As shown in FIGS. 20 and 21, the pressure supply passage 1317 of this embodiment may include first and second passages 1317*a*, 1317*b* disposed in the main bearing 131.

In FIG. 21, a flow provided to the intermediate back pressure pocket 1315*b* through the first to third passages 1317*a*, 1327*b*, 1317*c* in the compression space V is represented by arrows. The first passage 1317*a* is concavely disposed on one surface of the main bearing 131, and one side thereof may communicate with the compression space V to receive a pressure from the compression space V.

One surface of the main bearing 131 may be understood as a lower surface of the main bearing 131 in contact with the roller 134. The first passage 1317*a* may be a groove having a predetermined width and depth, and disposed in a radial direction.

An example in which the second passage 1317*b* is disposed to pass through one surface of the main bearing 131 to provide a pressure provided from the first passage 1317*a* to the intermediate back pressure pocket 1315*b* is shown in FIG. 20. Referring to FIG. 20, in order to provide a structure in which the second passage 1317*b* communicates with the first passage 1317*a*, an example in which when the first passage 1317*a* is disposed in the main bearing 131, the second passage 1317*b* is also disposed in the main bearing 131 is shown in FIG. 20.

Further, in the pressure supply passage 1317 of the first embodiment, one side of the second passage 1317*b* is provided on one surface of the main bearing 131, and may be spaced apart from the first passage 1317*a*. For example, the second passage 1317*b* may be provided in the main plate portion 1311 of the main bearing 131 described hereinafter.

Referring to FIGS. 20 and 21, an example is shown in which the first passage 1317*a* is concavely disposed on a bottom surface of the main bearing 131, and more particularly, an example is shown in which one (first) side of the first passage 1317*a* is disposed at a position in communication with the compression space V on an inner periphery of the cylinder 133, and the other (second) side thereof is disposed to communicate with the third passage 1317*c* described hereinafter.

Hereinafter, with reference to FIGS. 22 and 23, an example in which the pressure supply passage 1317' is provided in the main bearing 131 will be described. The pressure supply passage 1317' of this embodiment is different from the pressure supply passage 1317 in that one side of each of first and second passages 1317*a*', 1317*b*' is disposed in the microseism reduction chamber 1335.

The pressure supply passage 1317' of this embodiment may include the first and second passages 1317*a*', 1317*b*'. Referring to FIGS. 22 and 23, the first passage 1317*a*' in this embodiment may be concavely disposed on one surface of the main bearing 131, and one (first) side thereof may communicate with the compression space V to receive a pressure from the compression space V, and the other (second) side thereof may communicate with the microseism reduction chamber 1335.

One surface of the main bearing 131 may be understood as a lower surface of the main bearing 131 in contact with the roller 134. Further, an example in which the second passage 1317*b*' is disposed to pass through one surface of the main bearing 131 so as to communicate with the microseism reduction chamber 1335, and disposed to provide a pressure in the microseism reduction chamber 1335 to the intermediate back pressure pocket 1315*b* is shown in FIG. 23.

Referring to FIGS. 22 and 23, an example is shown in which the first passage 1317*a*' is disposed on one surface of the main bearing 131 (a bottom surface on the drawings), and the second passage 1317*b*' is disposed to pass through one surface of the main bearing 131, and provides communication between the microseism reduction chamber 1335 and the intermediate back pressure pocket 1315*b*.

The second passage 1317*b*' may include first and second holes 1317*b*1', 1317*b*2'. The first hole 1317*b*1' may be disposed to pass through one surface of the main bearing 131 toward an inside thereof. The second hole 1317*b*2' may intersect the first hole 1317*b*1', and one (first) side thereof may communicate with the first hole 1317*b*1' and the other (second) side thereof may communicate with the intermediate back pressure pocket 1315*b*.

Referring to FIGS. 22 and 23, an example is shown in which the first hole 1317*b*1' is disposed to pass from a bottom surface of the main bearing 131 toward an inside thereof, and a lower side of the second hole 1317*b*2' communicates with a lower end of the first hole 1317*b*1', and an upper side thereof communicates with the intermediate back pressure pocket 1315*b*. Referring to FIGS. 22 and 23, the configuration of the second passage 1317*b*' including the first and second holes 1317*b*1', 1317*b*2' in this embodiment is partially different from that of the first and second holes 1317*b*1, 1317*b*2 in an example of the previous embodiment, but an overall shape thereof has a structure of passing through the main bearing 131 in a V-shape to be similar to the previous embodiment.

Referring to FIG. 23, the microseism reduction chamber 1335 may be provided in the cylinder 133, and the microseism reduction chamber 1335 may be understood as a space for reducing the microseism of a pressure of the compression space V. The microseism reduction chamber 1335 may have a space of a preset or predetermined volume to communicate with the first and second passages 1317*a*', 1317*b*', and the pressure of the compression space V may be provided to the intermediate back pressure pocket 1315*b* through the first and second passages 1317*a*', 1317*b*' while reducing microseism.

Referring to FIG. 23, an example is shown of the microseism reduction chamber 1335 that is disposed along a circumferential direction on the left side of the compression space V and disposed to pass therethrough in a vertical direction, and one side on the left side of the second passage 1317*b*' provided to pass therethrough on a bottom surface of the main bearing 131 communicates with the microseism reduction chamber 1335. As shown in FIG. 22, when the compression cycle is repeated while the roller 134 rotates a plurality of times, the pressure of the compression space V moves into the microseism reduction chamber 1335 through the first passage 1317*a* to reduce microseism, and the pressure with the reduced microseism moves to the intermediate back pressure pocket 1315*b* through the second passage 1317*b*'. In FIG. 22, a flow in which the pressure of the compression space V is introduced into the microseism reduction chamber 1335 through the first passage 1317*a*', and the pressure with reduced microseism is provided again to the intermediate back pressure pocket 1315*b* through the first and second holes 1317*b*1', 1317*b*2' of the second passage 1317*b*' is represented by arrows.

Hereinafter, with reference to FIGS. 24 and 25, the pressure supply passage 1317" will be described. Referring to FIGS. 24 and 25, the pressure supply passage 1317" according to this embodiment may have a structure in which the first and second passages 1317*a*, 1317*b* directly communicate.

As described above, for the pressure supply passage 1317, the first and second passages communicate with each other by the third passage. On contrary, as shown in FIG. 13, the pressure supply passage 1317" in this embodiment has a structure in which the first and second passages 1317*a*, 1317*b* directly communicate, and is different from the pressure supply passage 1317 in that the third passage is not disposed in the roller 134.

Further, referring to FIGS. 24 and 25, an example is shown in which one side of the first passage 1317*a*" is disposed to overlap with one side of the second passage 1317*b*. The pressure supply passage 1317" of this embodiment may include first and second passages 1317*a*", 1317*b*.

The first passage 1317*a*" in this embodiment may be concavely disposed on one surface of the main bearing 131, and one (first) side thereof may communicate with the compression space V to receive a pressure from the compression space V, and the other (second) side thereof may communicate with the second passage 1317*b*. Further, the second passage 1317*b* may be disposed to pass through one surface of the main bearing 131 to provide a pressure provided through the first passage 1317*a*" in the compression space V to be provided to the intermediate back pressure pocket 1315*b*.

Referring to FIGS. 24 and 25, an example is shown in which the first passage 1317*a*" is disposed on a bottom surface of the main bearing 131, and the second passage 1317*b* is disposed to pass through the bottom surface of the main bearing 131, and provides communication between the first passage 1317*a*" and the intermediate back pressure pocket 1315*b*.

Referring to FIG. 24, the second passage 1317*b* may include first and second holes 1317*b*1, 1317*b*2. The first hole 1317*b*1 may be disposed to pass from one surface of the main bearing 131 toward an inside thereof, and may communicate with the first passage 1317*a*". The second hole 1317*b*2 may be disposed to intersect the first hole 1317*b*1, and one (first) side thereof may communicate with the first hole 1317*b*1 and the other (second) side thereof may communicate with the intermediate back pressure pocket 1315*b*.

Referring to FIGS. 24 and 25, an example is shown in which the first hole 1317*b*1 is disposed to pass from a bottom surface of the main bearing 131 toward an inside thereof, and a lower side of the second hole 1317*b*2 communicates with a lower end of the first hole 1317*b*1, and an upper side thereof communicates with the intermediate back pressure pocket 1315*b*.

Referring to FIGS. 24 and 25, the configuration of the second passage 1317*b* including the first and second holes 1317*b*1, 1317*b*2 in this embodiment is the same as the first and second holes 1317*b*1, 1317*b*2 (FIG. 20), and an overall shape thereof also has a structure of passing through the main bearing 131 in a V-shape, which is the same as the embodiment of FIG. 20.

As shown in FIG. 25, when the compression cycle is repeated while the roller 134 rotates a plurality of times, the pressure of the compression space V passes through the first passage 1317*a*" and passes through the second passage 1317*b* communicated therewith and moves to the intermediate back pressure pocket 1315*b*. In FIG. 25, a flow in which a pressure of the compression space V is provided to the intermediate back pressure pocket 1315*b* through the first passage 1317*a*" and the second passage 1317*b* is represented by arrows.

On the other hand, referring to FIG. 25, the cylinder 133 may be provided with the microseism reduction chamber 1335 having a space of a preset or predetermined volume to communicate with the intermediate back pressure pocket 1315*b* so as to reduce the microseism of the pressure of the compression space V.

An example in which the pressure supply passage 1317" further includes the fourth passage 1317*d* that allows the microseism reduction chamber 1335 and the intermediate back pressure pocket 1315*b* to communicate with each other, one (first) side of which is provided on one surface of the main bearing 131, and the other (second) side of which is connected to the second passage 1317*b* is shown in FIGS. 24 and 25.

Referring to FIGS. 26 and 27, the pressure supply passage 1317'" of this embodiment includes a first passage 1317*a*'" disposed to pass through one surface of the main bearing 131 and disposed to provide a pressure provided from the compression space V to the intermediate back pressure pocket 1315*b*. Further, the first passage 1317*a*'" is disposed to pass from one surface of the main bearing 131 toward an inside thereof, and one side thereof may include a first hole 1317*a*'"1 communicating with the compression space V; and a second hole 1317*a*'"2 disposed to intersect the first hole 1317*a*'"1, one (first) side of which communicates with the first hole 1317*a*'"1 and the other (second) side of which communicates with the intermediate back pressure pocket 1315*b*.

As described above, for the pressure supply passage 1317, the first and second passages 1317*a*, 1317*b* communicate with each other through the third passage 1317*c*, and on the contrary, as shown in FIG. 18, the pressure supply passage 1317'" has a structure in which the first passage 1317*a*'" provides direct communication between the back pressure pocket 1315*b* and the compression space V, and is different from the pressure supply 1317 in that the third passage 1317*c* is not disposed in the roller 134.

Referring to FIG. 26, the first passage 1317*a*'" may include first and second holes 1317*a*'"1, 1317*a*'"2. Referring to FIGS. 26 and 27, the configuration of the first passage 1317*a*'" including the first and second holes 1317*a*'"1, 1317*a*'"2 in this embodiment is different from the first and second holes 1317*b*1, 1317*b*2 as the first hole 1317*a*'"1 must communicate directly with the compression space V, and an overall shape thereof has a structure of passing through the main bearing 131 in a V-shape, which is the same as the embodiment of FIG. 20.

As shown in FIG. 27, when the compression cycle is repeated while the roller 134 rotates a plurality of times, the pressure of the compression space V passes through the first passage 1317*a*'" and moves to the intermediate back pressure pocket 1315*b*. In addition, in FIG. 27, a flow in which a pressure of the compression space V is provided to the intermediate back pressure pocket 1315*b* through the first passage 1317*a*'" is represented by arrows.

Further, referring to FIGS. 26 and 27, the cylinder 133 may be provided with the microseism reduction chamber 1335 having a space of a preset or predetermined volume to communicate with the intermediate back pressure pocket 1315*b* so as to reduce the microseism of the pressure of the compression space V. In addition, an example in which the pressure supply passage 1317'" further includes the second passage 1317*e* that allows the microseism reduction chamber 1335 and the intermediate back pressure pocket 1315*b* the main bearing communicate with each other, one (first) side of which is provided on one surface of the main bearing 131, and the other (second) side of which is connected to the first hole 1317*a*'"1 is shown in FIGS. 26 and 27.

As shown in FIG. 27, as the second passage 1317*e* has a relatively narrow passage compared to a volume of the microseism reduction chamber 1335, when the compression cycle is repeated while the roller 134 rotates a plurality of times, microseism occurring in the compression space V to communicate with the intermediate back pressure pocket 1315*b* is moved to the microseism reduction chamber 1335 through the second passage 1317*e*, and is reduced in the microseism reduction chamber 1335. The pressure supply passages 1317, 1327 may be respectively disposed in the main bearing 131 and the sub bearing 132 provided with the intermediate back pressure pockets 1315*b*, 1325*b*, respectively, and the pressure supply passage 1317, 1317', 1317", 1317'" disposed in the main bearing 131 and the pressure supply passage 1327, 1327', 1327", 1327'" disposed in the sub bearing 132 are symmetrically disposed to each other.

Due to this, it may be possible to prevent in advance the unbalance of force due to the passage which is disposed at only one surface of the roller 134 such that gas fills only the one surface of the roller 134 on one side only.

By such a configuration in which the pressure supply passage of the various embodiments is disposed in the main bearing 131, in the rotary compressor according to embodiments disclosed herein, a discharge pressure intermediate back pressure structure may be improved to a compression chamber pressure adaptive intermediate back pressure structure, thereby reducing contact friction loss acting on front ends of vanes. Further, a pressure supply passage having structure which provides communication between the compression space V and the intermediate back pressure pocket 1315*b* may be disposed, thereby improving wear reliability acting on front ends of vanes. In addition, vibration noise due to vibration at front ends of vanes during the operation of the compressor is reduced.

In the rotary compressor according to embodiments disclosed herein, a discharge pressure intermediate back pressure structure may be improved to a compression chamber pressure adaptive intermediate back pressure structure, thereby reducing contact friction loss acting on front ends of vanes. Further, a pressure supply passage having a structure which provides communication between a compression space and a back pressure pocket may be disposed, thereby improving wear reliability acting on front ends of vanes.

The rotary compressor according to embodiments disclosed herein may reduce vibration noise due to vibration at a front ends of vanes during the operation of the compressor. Further, according to embodiments disclosed herein may suppress generation of chattering noise during an initial start-up through improvement of sensitivity to formation of the vane back pressure during start-up.

In the rotary compressor according to embodiments disclosed herein, when a compression cycle is repeated while the roller rotates a plurality of times, due to a microseism reduction chamber and a passage that is relatively narrow compared to a volume of the microseism reduction chamber communicating therewith, microseism generated in the compression space is moved to the microseism reduction chamber, and reduced in the microseism reduction chamber. Microseism generated in a compression space may move to the microseism reduction chamber to reduce pressure microseism, thereby stabilizing the behavior of front ends of vanes.

When a pressure supply passage having structure which provides communication between a compression space and a back pressure pocket, due to a gas balance distribution groove, it may be possible to prevent in advance the unbalance of force due to a passage disposed at only one surface of a roller such that gas fills only the one surface of the roller on one side only.

Configurations and methods according to the above-described embodiments are not applicable in a limited way to the foregoing rotary compressor 100, and all or a portion of each embodiment may be selectively combined and configured to make various modifications thereto.

Embodiments disclosed herein provide a rotary compressor having structure for solving the problems of increased friction loss and reduced wear reliability at front ends of vanes in an operation region where a suction pressure is low as an intermediate pressure chamber back pressure acting on the vanes conforms to a discharge pressure. Embodiments disclosed herein further provide a rotary compressor having structure that allows the intermediate pressure chamber back pressure acting on the vanes to conform to a pressure of a compression chamber rather than the discharge pressure. Embodiments disclosed herein furthermore provide a rotary compressor having a structure capable of defining a pressure supply passage having a structure which provides communication between a compression space and a back pressure pocket.

Embodiments disclosed herein provide a rotary compressor that reduces vibration noise due to vibration at front ends of vanes during operation of the compressor. Embodiments disclosed herein also provide a rotary compressor capable of stabilizing the behavior of front ends of vanes inserted into a roller.

Further, in order to solve the problem of increased friction loss and reduced wear reliability at front ends of vanes, there is provided a rotary compressor having structure in which an intermediate back pressure chamber back pressure communicates with a compression chamber such that an intermediate pressure chamber back pressure conforms to a pressure of the compression chamber.

In addition, embodiments disclosed herein provide a rotary compressor having structure in which when a compression cycle is repeated while the roller rotates a plurality of times, microseism generated in a compression space is moved to a microseism reduction chamber to be reduced in the microseism reduction chamber. Moreover, embodiments disclosed herein provide a rotary compressor capable of moving microseism generated in a compression space to the microseism reduction chamber to reduce pressure microseism, thereby stabilizing the behavior of front ends of vanes.

Embodiments disclosed herein provide a rotary compressor having structure capable of preventing in advance the unbalance of force due to a passage that is disposed only on one surface of the roller such that gas fills only the one surface of the roller on one side only.

According to embodiments disclosed herein, a rotary compressor may include a cylinder an inner peripheral surface of which is defined in an annular shape to define a compression space, provided with a suction port configured to communicate with the compression space to suction and provide refrigerant to the compression space; a roller rotatably provided in the compression space of the cylinder, and provided with a plurality of vane slots providing a back pressure at one side thereinside at predetermined intervals along an outer peripheral surface; a plurality of vanes slidably inserted into the vane slots to rotate together with the roller, front end surfaces of which come into contact with an inner periphery of the cylinder by the back pressure to partition the compression space into a plurality of compression chambers; and a main bearing and a sub bearing provided at both ends of the cylinder, respectively, and disposed to be spaced apart from each other to define both surfaces of the compression space, respectively. An intermediate back pressure pocket disposed to communicate with one side of the vane slot so as to provide a back pressure at an intermediate pressure is provided in at least one of the main bearing or the sub bearing, and a pressure supply passage that provides communication between the compression space and the intermediate back pressure pocket is disposed in at least one of the main bearing or the sub bearing. Due to this, the pressure of the compression space may be provided to the intermediate back pressure pocket, thereby improving contact friction loss and wear reliability acting on front ends of vanes.

The pressure supply passage may include a first passage concavely disposed on one surface of at least one of the sub bearing or the main bearing, one side of which communicates with the compression space to receive a pressure from the compression space; and a second passage disposed to pass through one surface of at least one of the sub bearing or the main bearing so as to communicate with the first passage to provide a pressure provided from the first passage to the intermediate back pressure pocket. Due to this, the pressure of the compression space may be provided to the intermediate back pressure pocket such that a back pressure at an intermediate pressure acts on rear ends of vanes, thereby improving contact friction loss and wear reliability acting on front ends of the vanes. Moreover, it may be possible to suppress generation of chattering noise during an initial start-up through improvement of sensitivity to formation of the vane back pressure during the start-up.

The pressure supply passage may further include a third passage provided on one surface of the roller to provide communication between the first and second passages to supply a pressure provided from the first passage to the second passage. Further, one side of the first passage may overlap with one side of the second passage such that the first passage and the second passage directly communicate with each other.

The first passage may be a groove having a predetermined width and depth, and disposed in a direction crossing a radial direction. The first passage may be disposed at a position in communication with the compression space at one position opposite to a proximal point in contact between an outer peripheral surface of the roller and an inner peripheral surface of the cylinder.

The third passage may be a plurality of grooves spaced apart from one another disposed along a circumferential direction on one surface of the roller. A plurality of grooves having a same shape as that of the third passage may be provided on the other surface provided at an opposite side to the one surface of the roller, and the third passage and the grooves having the same shape as that of the third passage may be disposed to be symmetrical on different surfaces of the roller. The first passage may be a groove having a predetermined width and depth, and disposed in a radial direction.

The second passage may include a first hole disposed to pass from one surface of at least one of the sub bearing or the main bearing toward an inside thereof, and a second hole disposed to intersect the first hole, one (first) side of which communicates with the first hole, and the other (second) side of which communicates with the intermediate back pressure pocket. One side of the first hole provided on one surface of at least one of the sub bearing or the main bearing may be spaced apart from the first passage.

According to another embodiment, the second passage may include a first hole disposed to pass through one surface of at least one of the sub bearing or the main bearing toward an inside thereof; a second hole spaced apart from the first hole to be in parallel thereto, one side of which communicates with the intermediate back pressure pocket; and a third hole disposed to intersect the first hole and the second hole, respectively, so as to provide communication between the first hole and the second hole.

The cylinder may be provided with a microseism reduction chamber having a space of a preset or predetermined volume to communicate with the intermediate back pressure pocket so as to reduce the microseism of a pressure of the compression space. The pressure supply passage may further include a fourth passage that allows the microseism reduction chamber and the intermediate back pressure pocket to communicate with each other, one (first) side of which is provided on one surface of at least one of the sub bearing and the main bearing, and the other (second) side of which is connected to the second passage.

According to still another embodiment, the cylinder may be provided with a microseism reduction chamber having a space of a preset or predetermined volume to communicate with the intermediate back pressure pocket so as to reduce the microseism of a pressure of the compression space, and the pressure supply passage may include a first passage concavely disposed on one surface of at least one of the sub bearing or the main bearing, one (first) side of which communicates with the compression space to receive a pressure from the compression space, and the other (second) side of which communicates with the microseism reduction chamber; and a second passage disposed to pass through one surface of at least one of the sub bearing or the main bearing so as to communicate with the microseism reduction chamber to provide a pressure in the microseism reduction chamber to the intermediate back pressure pocket. When a compression cycle is repeated while the roller rotates a plurality of times, due to a configuration of the microseism reduction chamber and a passage that is relatively narrow compared to a volume of the microseism reduction chamber communicating therewith, microseism generated in the compression space may be moved to the microseism reduction chamber, and reduced in the microseism reduction chamber.

The pressure supply passage may include a first passage disposed to pass through one surface of at least one of the sub bearing or the main bearing so as to provide a pressure provided from the compression space to the intermediate back pressure pocket. The first passage may include a first hole disposed to pass through one surface of at least one of the sub bearing or the main bearing toward an inside thereof, one side of which communicates with the compression space; and a second hole disposed to intersect the first hole, one (first) side of which communicates with the first hole, and the other (second) side of which communicates with the intermediate back pressure pocket.

The cylinder may be provided with a microseism reduction chamber having a space of a preset or predetermined volume to communicate with the intermediate back pressure pocket so as to reduce the microseism of a pressure of the compression space.

According to yet still another embodiment, the pressure supply passage may further include a second passage that allows the microseism reduction chamber and the intermediate back pressure pocket to communicate with each other, one (first) side of which is provided on one surface of at least one of the sub bearing and the main bearing, and the other (second) side of which is connected to the first hole. Further, the cylinder may be provided with a microseism reduction chamber having a space of a preset or predetermined volume to communicate with the intermediate back pressure pocket so as to reduce the microseism of a pressure of the compression space.

The pressure supply passage may further include a fourth passage that allows the microseism reduction chamber and the intermediate back pressure pocket to communicate with each other, one (first) side of which is provided on one surface of at least one of the sub bearing and the main bearing, and the other (second) side of which is connected to the second passage. When a compression cycle is repeated while the roller rotates a plurality of times, due to a configuration of the microseism reduction chamber and a passage that is relatively narrow compared to a volume of the microseism reduction chamber communicating therewith, microseism generated in the compression space may be moved to the microseism reduction chamber, and reduced in the microseism reduction chamber.

According to still yet another embodiment, the pressure supply passage may be disposed in each of the main bearing and the sub bearing, which are respectively provided with the intermediate back pressure pocket, and a pressure supply passage disposed in the main bearing and a pressure supply passage disposed in the sub bearing may be symmetrically disposed to each other.

It is obvious to those skilled in the art that embodiments may be embodied in other specific forms without departing from the concept and essential characteristics thereof. The description is therefore to be construed in all aspects as illustrative and not restrictive. The scope should be determined by reasonable interpretation of the appended claims and all changes that come within the equivalent scope are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a cylinder, an inner peripheral surface of which is defined in an annular shape to define a compression space, provided with a suction port configured to communicate with the compression space to suction and provide refrigerant to the compression space;

a roller rotatably provided in the compression space of the cylinder, and including with a plurality of vane slots provided at predetermined intervals along an outer peripheral surface, the plurality of vane slots each providing a back pressure at one side thereinside;

a plurality of vanes slidably inserted into the plurality of vane slots, respectively, to rotate together with the roller, wherein front end surfaces of the plurality of vanes come into contact with an inner peripheral surface of the cylinder due to the back pressure to partition the compression space into a plurality of compression chambers; and a main bearing and a sub bearing provided at both ends of the cylinder, respectively, and spaced apart from each other to define surfaces of the compression space, respectively, wherein an intermediate back pressure pocket configured to communicate with one side of the plurality of vane slots so as to provide the back pressure at an intermediate pressure is provided in at least one of the main bearing or the sub bearing, and wherein a pressure supply passage that provides communication between the compression space and the intermediate back pressure pocket is disposed in the at least one of the main bearing or the sub bearing, wherein the pressure supply passage comprises:

a first passage concavely disposed on a surface of the at least one of the sub bearing or the main bearing, one side of which communicates with the compression space to receive a pressure from the compression space;

a second passage disposed to pass through the surface of the at least one of the sub bearing or the main bearing so as to communicate with the first passage to provide the pressure provided from the first passage to the intermediate back pressure pocket; and a third passage provided on a surface of the roller to provide communication between the first passage and the second passage to supply the pressure provided from the first passage to the second passage.

2. The rotary compressor of claim 1, wherein the third passage comprises a plurality of grooves spaced apart from one another along a circumferential direction on a first surface of the roller.

3. The rotary compressor of claim 2, wherein a plurality of grooves having a same shape as the plurality of grooves of the third passage is provided on a second surface provided at an opposite side to the first surface of the roller, and wherein the third passage and the plurality of grooves having a same shape as the plurality of grooves of the third passage are disposed to be symmetrical on different surfaces of the roller.

4. The rotary compressor of claim 1, wherein the cylinder is provided with a microseism reduction chamber having a space of a predetermined volume to communicate with the intermediate back pressure pocket so as to reduce a microseism of the pressure of the compression space.

5. The rotary compressor of claim 4, wherein the pressure supply passage further comprises:

a fourth passage that allows the microseism reduction chamber and the intermediate back pressure pocket to communicate with each other, a first side of which is provided on the surface of at least one of the sub bearing or the main bearing, and a second side of which is connected to the second passage.

6. The rotary compressor of claim 1, wherein one side of the first passage overlaps with one side of the second passage such that the first passage and the second passage directly communicate with each other.

7. The rotary compressor of claim 1, wherein the first passage is disposed at a position in communication with the compression space, the position being opposite to a proximal point of contact between the outer peripheral surface of the roller and the inner peripheral surface of the cylinder.

8. The rotary compressor of claim 1, wherein the first passage comprises a groove having a predetermined width and depth, and extending in a radial direction.

9. The rotary compressor of claim 1, wherein the second passage comprises:

a first hole that passes from the surface of at least one of the sub bearing or the main bearing toward an inside thereof; and a second hole that intersects the first hole, a first side of which communicates with the first hole, and a second side of which communicates with the intermediate back pressure pocket.

10. The rotary compressor of claim 9, wherein the cylinder is provided with a microseism reduction chamber having a space of a predetermined volume to communicate with the intermediate back pressure pocket so as to reduce a microseism of a pressure of the compression space.

11. The rotary compressor of claim 1, wherein the cylinder is provided with a microseism reduction chamber having a space of a predetermined volume to communicate with the intermediate back pressure pocket so as to reduce a microseism of a pressure of the compression space, and wherein a second side of the first passage communicates with the microseism reduction chamber and the second passage communicates with the microseism reduction chamber to provide a pressure in the microseism reduction chamber to the intermediate back pressure pocket.

12. The rotary compressor of claim 11, wherein the second passage comprises:

a first hole that passes from the surface of the at least one of the sub bearing or the main bearing toward an inside thereof; and a second hole that intersects the first hole, a first side of which communicates with the first hole, and a second side of which communicates with the intermediate back pressure pocket.

13. The rotary compressor of claim 1, wherein the first passage passes through the surface of at least one of the sub bearing or the main bearing so as to provide the pressure provided from the compression space to the intermediate back pressure pocket.

14. The rotary compressor of claim 13, wherein the first passage comprises:

a first hole that passes through the surface of at least one of the sub bearing or the main bearing toward an inside thereof, one side of which communicates with the compression space; and a second hole that intersects the first hole, a first side of which communicates with the first hole, and a second side of which communicates with the intermediate back pressure pocket.

15. The rotary compressor of claim 14, wherein the cylinder is provided with a microseism reduction chamber having a space of a predetermined volume to communicate with the intermediate back pressure pocket so as to reduce a microseism of the pressure of the compression space.

16. The rotary compressor of claim 15, wherein the second passage allows the microseism reduction chamber and the intermediate back pressure pocket to communicate with each other, a first side of which is provided on the surface of at least one of the sub bearing or the main bearing, and a second side of which is connected to the first hole.

17. The rotary compressor of claim 1, wherein the pressure supply passage is disposed in each of the main bearing and the sub bearing, which are respectively provided with the intermediate back pressure pocket, and wherein the pressure supply passage disposed in the main bearing and the pressure supply passage disposed in the sub bearing are symmetrically disposed to each other.

18. A rotary compressor, comprising:

a cylinder, an inner peripheral surface of which is defined in an annular shape to define a compression space, provided with a suction port configured to communicate with the compression space to suction and provide refrigerant to the compression space;

a roller rotatably provided in the compression space of the cylinder, and including with a plurality of vane slots provided at predetermined intervals along an outer peripheral surface, the plurality of vane slots each providing a back pressure at one side thereinside;

a plurality of vanes slidably inserted into the plurality of vane slots, respectively, to rotate together with the roller, wherein front end surfaces of the plurality of vanes come into contact with an inner peripheral surface of the cylinder due to the back pressure to partition the compression space into a plurality of compression chambers; and a main bearing and a sub bearing provided at both ends of the cylinder, respectively, and spaced apart from each other to define surfaces of the compression space, respectively, wherein an intermediate back pressure pocket configured to communicate with one side of the plurality of vane slots so as to provide the back pressure at an intermediate pressure is provided in at least one of the main bearing or the sub bearing, wherein a pressure supply passage that provides communication between the compression space and the intermediate back pressure pocket is disposed in the at least one of the main bearing or the sub bearing, wherein the pressure supply passage comprises:

a first passage concavely disposed on a surface of the at least one of the sub bearing or the main bearing, one side of which communicates with the compression space to receive a pressure from the compression space; and a second passage disposed to pass through the surface of the at least one of the sub bearing or the main bearing so as to communicate with the first passage to provide the pressure provided from the first passage to the intermediate back pressure pocket, wherein the cylinder is provided with a microseism reduction chamber having a space of a predetermined volume to communicate with the intermediate back pressure pocket so as to reduce a microseism of a pressure of the compression space, and wherein the pressure supply passage further comprises:

a fourth passage that allows the microseism reduction chamber and the intermediate back pressure pocket to communicate with each other, a first side of which is provided on the surface of at least one of the sub bearing or the main bearing, and a second side of which is connected to the second passage, wherein the second passage comprises:

a first hole that passes from the surface of at least one of the sub bearing or the main bearing toward an inside thereof; and a second hole that intersects the first hole, a first side of which communicates with the first hole, and a second side of which communicates with the intermediate back pressure pocket, and wherein a first side of the first hole provided on the surface of at least one of the sub bearing or the main bearing is spaced apart from the first passage.

19. A rotary compressor, comprising:

a cylinder, an inner peripheral surface of which is defined in an annular shape to define a compression space, provided with a suction port configured to communicate with the compression space to suction and provide refrigerant to the compression space;

a roller rotatably provided in the compression space of the cylinder, and including with a plurality of vane slots provided at predetermined intervals along an outer peripheral surface, the plurality of vane slots each providing a back pressure at one side thereinside;

a plurality of vanes slidably inserted into the plurality of vane slots, respectively, to rotate together with the roller, wherein front end surfaces of the plurality of vanes come into contact with an inner peripheral surface of the cylinder due to the back pressure to partition the compression space into a plurality of compression chambers; and a main bearing and a sub bearing provided at both ends of the cylinder, respectively, and spaced apart from each other to define surfaces of the compression space, respectively, wherein an intermediate back pressure pocket configured to communicate with one side of the plurality of vane slots so as to provide the back pressure at an intermediate pressure is provided in at least one of the main bearing or the sub bearing, and wherein a pressure supply passage that provides communication between the compression space and the intermediate back pressure pocket is disposed in the at least one of the main bearing or the sub bearing, wherein the pressure supply passage comprises:

a first passage concavely disposed on a surface of the at least one of the sub bearing or the main bearing, one side of which communicates with the compression space to receive a pressure from the compression space; and a second passage disposed to pass through the surface of the at least one of the sub bearing or the main bearing so as to communicate with the first passage to provide the pressure provided from the first passage to the intermediate back pressure pocket, and wherein the second passage comprises:

a first hole that passes through the surface of at least one of the sub bearing or the main bearing toward an inside thereof;

a second hole spaced apart from the first hole to be parallel thereto, one side of which communicates with the intermediate back pressure pocket; and a third hole disposed to intersect the first hole and the second hole, respectively, so as to provide communication between the first hole and the second hole.

* * * * *